US009362022B2

(12) United States Patent
Kamiyama et al.

(10) Patent No.: US 9,362,022 B2
(45) Date of Patent: Jun. 7, 2016

(54) COMPOSITE ELECTRIC CABLE AND PROCESS FOR PRODUCING SAME

(75) Inventors: Hideki Kamiyama, Tokyo (JP); Hiroji Akasaka, Tokyo (JP); Masato Tachibana, Tokyo (JP); Hiroaki Rikihisa, Tokyo (JP); Takuzo Hagiwara, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 945 days.

(21) Appl. No.: 13/515,671

(22) PCT Filed: Jan. 20, 2011

(86) PCT No.: PCT/JP2011/051009

§ 371 (c)(1),
(2), (4) Date: Jun. 13, 2012

(87) PCT Pub. No.: WO2011/090133

PCT Pub. Date: Jul. 28, 2011

(65) Prior Publication Data

US 2012/0267141 A1 Oct. 25, 2012

(30) Foreign Application Priority Data

Jan. 20, 2010 (JP) ..... 2010-010330

(51) Int. Cl.
*H01B 7/18* (2006.01)
*H01B 13/00* (2006.01)
(Continued)

(52) U.S. Cl.
CPC ..... *H01B 5/105* (2013.01); *B21C 37/047* (2013.01); *C22C 21/00* (2013.01); *C22C 21/08* (2013.01);
(Continued)

(58) Field of Classification Search
CPC ..... H01B 1/02; H01B 1/023
USPC ..... 174/119 R, 106 R, 126.2, 128.1, 126.1, 174/129 R
See application file for complete search history.

(56) References Cited

U.S. PATENT DOCUMENTS 6,180,232 B1 * 1/2001 McCullough ..... C22C 47/025 174/113 R
6,329,056 B1 * 12/2001 Deve ..... C22C 47/062 164/100

(Continued)

FOREIGN PATENT DOCUMENTS

JP A-2-223105 9/1990
JP A-9-245527 9/1997

(Continued)

OTHER PUBLICATIONS

Apr. 19, 2011 International Search Report issued in PCT/JP2011/051009.

(Continued)

*Primary Examiner* — Hoa C Nguyen
*Assistant Examiner* — Amol Patel
(74) *Attorney, Agent, or Firm* — Oliff PLC

(57) ABSTRACT

A composite electric cable including a plurality of element wires twisted together. The element wires include a material wire formed of a composite material containing an aluminum material and carbon nanotubes dispersed in the aluminum material; the material wire has a cellulation structure including a wall portion containing the carbon nanotubes and an inside portion of the wall which is surrounded by the wall portion and which comprises the aluminum material and unavoidable impurities; the material wire has a ratio of carbon nanotube content to aluminum material content of 0.2 wt. % to 5 wt. %; and each of all the element wires forming the composite electric cable is the material wire, or the composite electric cable includes in a center portion thereof one or a plurality of steel wires.

24 Claims, 17 Drawing Sheets

(51) Int. Cl.

| | |
|---|---|
| ***H01B 5/08*** | (2006.01) |
| ***H01B 7/00*** | (2006.01) |
| ***B82Y 99/00*** | (2011.01) |
| ***B82Y 30/00*** | (2011.01) |
| ***H01B 5/10*** | (2006.01) |
| ***B21C 37/04*** | (2006.01) |
| ***C22C 21/00*** | (2006.01) |
| ***C22C 21/08*** | (2006.01) |
| ***C22C 26/00*** | (2006.01) |
| ***C22C 47/06*** | (2006.01) |
| ***C22F 1/04*** | (2006.01) |

(52) U.S. Cl.
CPC ..... *C22C 26/00* (2013.01); *C22C 47/062* (2013.01); *C22F 1/04* (2013.01); *B22F 2303/01* (2013.01); *C22C 2026/002* (2013.01)

(56) References Cited

U.S. PATENT DOCUMENTS 6,344,270 B1 * 2/2002 McCullough ..... C22C 47/08 164/100
6,576,844 B1 * 6/2003 Kamata ..... H01B 5/105 174/108
6,723,451 B1 * 4/2004 McCullough ..... C04B 41/009 174/113 R
8,445,788 B1 * 5/2013 Tsotsis ..... H01B 1/24 174/126.1
2004/0026112 A1 * 2/2004 Goldsworthy ..... G02B 6/255 174/106 R
2005/0279527 A1 * 12/2005 Johnson ..... H01B 13/0235 174/106 R
2010/0263911 A1 * 10/2010 Watanabe ..... C23C 10/28 174/126.2
2010/0263912 A1 * 10/2010 Watanabe ..... C23C 26/00 174/126.2

FOREIGN PATENT DOCUMENTS

| | | |
|---|---|---|
| JP | A-2001-176333 | 6/2001 |
| JP | A-2004-327254 | 11/2004 |
| JP | A-2007-157372 | 6/2007 |
| JP | A-2008-277077 | 11/2008 |
| JP | A-2009-021038 | 1/2009 |
| WO | WO 2006/120803 A1 | 11/2006 |

OTHER PUBLICATIONS

Apr. 19, 2011 Translation of Written Opinion issued in PCT/JP2011/051009.
Office Action issued in Japanese Patent Application No. 2011-550956 dated Sep. 30, 2014 (with translation).
Office Action issued in Japanese Patent Application No. 2011-010191 dated Sep. 30, 2014 (with translation).

* cited by examiner (a)

(b)

(c)

(d)

(a)

(b)

(a)

(b)

(a)

(b)

(a)

(b)

COMPOSITE ELECTRIC CABLE AND PROCESS FOR PRODUCING SAME

TECHNICAL FIELD

The present invention relates to a low-sag, increased-capacity composite electric cable including twisted material wires as element wires, each material wire being formed from a composite material comprising an aluminum material and carbon nanotubes dispersed therein.

BACKGROUND ART

Hitherto, the transmission capacity of an overhead transmission line (an overhead power electric transmission line) has been increased by means of increasing the size (diameter) of an electric cable. However, as the cable size increases, the mass of the cable increases, and the required sag of the electric cable increases. That is, sufficient space under the transmission line cannot be provided. Also, when the electric cable size is increased, the wind load of the electric cable increases and exceeds the design load of a transmission line tower. Currently, in a capacity-increasing zone, additional tower segments are added so as to bring transmission line towers to a higher level, in order to contend with the increase in sag.

Meanwhile, one conventional electric cable which exhibits an increased transmission capacity is a gap electric cable in which compressed aluminum wires (trapezoidal aluminum wires) surrounding a steel wire are twisted together, to thereby provide a gap between the steel wire and the aluminum wires. In this structure, tension is received only by the galvanized steel wire, and the aluminum wires receive no tension. This electric cable, which exhibits a linear expansion coefficient at high temperature smaller than that of conventional ACSR (aluminum cable steel reinforced), can attain low sag and an increased capacity; about 1.6 times that of ACSR.

Other conventionally employed electric cables which exhibit an increased transmission capacity include Invar electric cables such as galvanized Inver-reinforced extra-heat-resistant aluminum alloy twisted wire (ZTACIR) employing an Invar wire having a small linear expansion coefficient at high temperature instead of a steel wire, and aluminum-coated Inver-reinforced extra-heat-resistant aluminum alloy twisted wire (XTACIR). Since the linear expansion coefficient of Invar wire is as small as ½ to ⅓ that of a galvanized steel wire generally employed in ACSR, the electric cable produced therefrom exhibits small expansion even at high temperature, whereby a sag equivalent to that of ACSR can be attained. In addition, since the outer diameter of the electric cable is equivalent to that of a conventional electric cable, the wind load of a transmission line tower does not increase.

However, the pile-up work of transmission line tower must be carried out while overhead transmission lines are in an active transmission state, and the work requires a long period of working time as compared with general transmission line tower construction and a very high construction cost.

The gap electric cable, provided with a gap between the steel wire and the aluminum layer, is hanged on the overhead transmission line tower by a different electric cable fastening method. When an electric cable is gripped at the surface thereof, similar to the case of conventional ACSR, only the aluminum layer is gripped, and the gripping force does not transfer to the center steel wire portion. Thus, a special gripping metal fitting or tool is needed, which prolongs a work period and requires professional technicians.

An Invar electric cable is an expensive material (i.e., cost is quadruple that of conventional electric cable).

In countries outside Japan, ACAR (aluminum conductor alloy reinforced), which is a product formed by twisting aluminum wires and high-strength aluminum wires together, is employed. Since the product employs no steel wire, the electric cable obtained therefrom is a lightweight cable, requiring a small sag. However, if a fire (e.g., a forest fire or housing fire) occurs under a transmission cable, an aluminum wire is heated at a temperature higher than the melting point, resulting in breakage of the electric cable due to absence of steel wire.

Meanwhile, carbon nanotube is a substance which is formed of a single-layer graphene (carbon) sheet or multi-layer graphene sheets, the sheet(s) forming a co-axial tubular structure. Carbon nanotube is a material having meritorious properties: ultrafine pore size, light weight, high strength, high flexibility, high current density, high thermal conductivity, and high electrical conductivity. Hitherto, a material wire has been formed from a composite material containing carbon nanotubes and aluminum, and an electric cable has been tried to form from element wires including the material wires.

For example, there has been disclosed a high-thermal-conductivity composite material comprising a discharge plasma sintered product mainly formed of metal powder serving as a base material and, uniformly dispersed in the base material to attain a homogeneous state, a fibrous carbon material formed of a ultrathin tubular material comprising single-layer and multi-layer graphene (see Patent Document 1).

There has been also disclosed an element wire in which a plurality of carbon nanotubes are embedded in the metal base forming the element wire such that the carbon nanotubes are aligned in a controlled orientation (see Patent Document 2).

PRIOR ART DOCUMENTS

Patent Documents

Patent Document 1: WO 2006/120803
Patent Document 2: JP-A-2008-277077

SUMMARY OF THE INVENTION

Problems to be Solved by the Invention

However, the invention of Patent Document 1 is not directed to be formed to a material wire. Therefore, the metallographic structure has no anisotropy. In general, in electrically conductive wires, the mechanical strength required in the longitudinal direction is not equivalent to the mechanical strength required in the direction orthogonal to the longitudinal direction. Thus, an anisotropic metallographic structure is advantageous for attaining a required mechanical strength, in particular flexibility, of a conductive wire both in the longitudinal direction and in the direction orthogonal to the longitudinal direction through addition of small amounts of carbon nanotubes. In this regard, difficulty is encountered in giving anisotropy to the metallographic structure in the invention of Patent Document 1.

In the invention of Patent Document 2, the final product has a material structure including a metallographic structure and a carbon nanotube structure which are different from each other. These different structures are separately present to form a combined structure so that different structures are to be adjacent to each other. Therefore, electrical connection and thermal contact between carbon nanotube and metal cannot be sufficiently ensured, which is problematic. That is, according to the invention of Patent Document 2, excellent electrical conductivity and thermal conductivity which are intrinsically possessed by carbon nanotube cannot fully be attained.

In addition, in the invention of Patent Document 1, a plurality of carbon nanotubes are entangled with one another in the carbon nanotube structure which has been incorporated into the metallographic structure. Thus, although the carbon nanotube itself has a very small diameter, the carbon nanotube structure has a size of some micrometers. The structure of such a size is a heterogeneous material in metallic material. In general, when a heterogeneous material is present in metal, stress concentration occurs at the interface between the heterogeneous material and metal, and cracking occurs and proceeds from the stress concentrated site. Since the material structure of the invention of Patent Document 1 contains a large amount of heterogeneous materials, the material is not suited for plastic working. As a result, difficulty is encountered in combining metal and carbon nanotubes to form an optimum structure in the technique of Patent Document 1.

Means for Solving the Problems

The present invention has been conceived in order to solve the aforementioned problems. Thus, an object of the present invention is to provide a low-sag, increased-capacity composite electric cable including twisted material wires, each material wire being formed from a composite material which is an aluminum material containing carbon nanotubes dispersed therein and which has high mechanical strength and excellent electrical conductivity.

Accordingly, the present invention provides the following inventions.

(1) A composite electric cable including a plurality of element wires twisted together, characterized in that:

the element wires include a material wire formed of a composite material comprising an aluminum material and carbon nanotubes dispersed in the aluminum material;

the material wire has a cellulation structure including a wall portion containing the carbon nanotubes and an inside portion of the wall which is surrounded by the wall portion and which comprises the aluminum material and unavoidable impurities;

the material wire has a ratio of carbon nanotube content to aluminum material content of 0.2 wt. % to 5 wt. %;

the material wire has a tensile strength of 150 MPa or higher and a linear expansion coefficient of $10\times10^{-6}$/K or less as measured at 293 K; and each of all the element wires forming the composite electric cable is the material wire, or the composite electric cable includes in a center portion thereof one or a plurality of steel wires.

(2) A composite electric cable as described in (1) above, wherein:

the material wire has a plurality of similar cellulation structures as viewed in a cross section the material wire orthogonal to the longitudinal direction thereof;

the inside portion of the wall of the material wire is long in the longitudinal direction of the material wire and short in a direction orthogonal to the longitudinal direction of the material wire; and at least a part of the wall portion has a generally tubular shape such that the longitudinal direction of the wall portion is approximately parallel to the longitudinal direction of the composite material wire.

(3) A composite electric cable as described in (1) or (2) above, wherein at least a part of the inside portion of the wall of the material wire assumes a polycrystalline structure formed of a plurality of crystal grains.

(4) A composite electric cable as described in any of (1) to (3) above, wherein:

the wall portion of the material wire has a textile-like structure formed of a plurality of carbon nanotubes;

the textile-like structure encloses the aluminum material in the inside portion of the wall enclosed by the wall portion;

the carbon nanotubes forming the wall portion are in contact with the surface of the inside portion of the wall formed of the aluminum material and are themselves in contact with one another; and the material wire has both the cellulation structure in a cross section parallel to the longitudinal direction thereof and in a cross section orthogonal to the longitudinal direction thereof.

(5) A composite electric cable as described in any of (1) to (4) above, wherein the material wire has a core portion containing carbon nanotubes and having the cellulation structure, and a clad portion having a carbon nanotube concentration lower than that of the core portion or containing no carbon nanotube and having no cellulation structure.

(6) A composite electric cable as described in any of (1) to (5) above, wherein the material wire has first and second regions alternately and concentrically arranged, wherein the first region comprises an aluminum material and unavoidable impurities and has no cellulation structure, and the second region contains carbon nanotubes and has the cellulation structure.

(7) A composite electric cable as described in any of (1) to (6) above, wherein the wall portion of the material wire contains carbon nanotubes in an amount greater than the amount of carbon nanotubes in the inside portion of the wall.

(8) A composite electric cable as described in any of (1) to (7) above, wherein the wall portion of the material wire has an aluminum oxide concentration higher than that of the inside portion of the wall.

(9) A composite electric cable as described in any of (1) to (8) above, wherein:

a plurality of wall portions of the cellulation structure are in contact with one another as viewed in a cross section of the material wire orthogonal to the longitudinal direction thereof;

the wall portion of the material wire has a circle-like or elliptic shape including a line as a part thereof, or a generally polygonal shape formed by a plurality of lines; and the material wire has a plurality of similar cellulation structures as viewed in a cross section of the material wire orthogonal to the longitudinal direction thereof.

(10) A composite electric cable as described in any of (1) to (9) above, wherein each carbon nanotube contained in the material wire is bent and/or deformed, as viewed in a cross section of the carbon nanotube in a direction orthogonal to the longitudinal direction thereof, as a result of application of a stress applied to the carbon nanotube in a direction orthogonal to the longitudinal direction thereof.

(11) A composite electric cable as described in any of (1) to (10) above, wherein the wall portion of the material wire contains carbon nanotubes having a length of 1 μM or shorter, and a plurality of inside portions of the walls are connected to one another by the mediation of carbon nanotubes having a length of 10 μm or longer.

(12) A composite electric cable as described in any of (1) to (11) above, wherein the material wire contains carbon nanotubes having a length of 1 μm or shorter and carbon nanotubes having a length of 10 μm or longer, and has a peak in the length region of 1 μm or shorter and a peak in the length region of 10 μm or longer, observed in a length distribution profile thereof.

(13) A composite electric cable as described in any of (1) to (12) above, wherein the element wires include an aluminum wire and/or an aluminum alloy wire in combination with the material wire.

(14) A composite electric cable as described in any of (1) to (13) above, wherein the material wire has a tensile strength equal to or higher than that of aluminum and an electrical conductivity 90% or higher that of aluminum.

(15) A composite electric cable as described in any of (1) to (14) above, wherein the material wire has a linear expansion coefficient equal to or lower than that of aluminum and an electrical conductivity 90% or higher that of aluminum.

(16) A composite electric cable as described in any of (1) to (15) above, wherein the material wire has a melting temperature equal to or higher than that of aluminum and an electrical conductivity 90% or higher that of aluminum.

(17) A composite electric cable which a composite electric cable as recited in any of (1) to (16) coated with a resin.

(18) A method for producing a composite electric cable, the method comprising:

a step (a) of mixing an elastomer, aluminum material particles, and carbon nanotubes, to thereby prepare a mixture;

a step (b) of heating the mixture so as to vaporize and decompose the elastomer, to thereby prepare a raw material;

a step (c) of sintering the raw material, to thereby form a billet;

a step (d) of drawing the billet through a die, to thereby form a material wire made of a composite material; and a step (e) of twisting together element wires including the material wire.

(19) A method for producing a composite electric cable, the method comprising:

a step (a) of mixing an elastomer, aluminum material particles, and carbon nanotubes, to thereby prepare a mixture;

a step (b) of heating the mixture so as to vaporize and decompose the elastomer, to thereby prepare a raw material;

a step (c) of sintering the raw material, to thereby form a billet;

a step (d) of hot-extruding the billet, to thereby form an extruded material wire made of a composite material; and a step (e) of twisting together element wires including the material wire.

(20) A method for producing a composite electric cable, the method comprising:

a step (a) of mixing an elastomer, aluminum material particles, and carbon nanotubes, to thereby prepare a mixture;

a step (b) of heating the mixture so as to vaporize and decompose the elastomer, to thereby prepare a raw material;

a step (c) of sintering the raw material, to thereby form a billet;

a step (d) of hot-extruding the billet, to thereby form an extruded material;

a step (e) of drawing the extruded material through a die, to thereby form a material wire made of a composite material; and a step (f) of twisting together element wires including the material wire.

Effects of the Invention

The present invention has been conceived in order to solve the aforementioned problems. According to the present invention, there can be provided a low-sag, increased-capacity composite electric cable including twisted material wires, each material wire being formed from a composite material which is an aluminum material containing carbon nanotubes dispersed therein and which has high mechanical strength and excellent electrical conductivity.

MODES FOR CARRYING OUT THE INVENTION

With reference to the drawings, embodiments of the present invention will be described in detail. Note that the drawings are schematic views in which the dimensions of the members are given on an arbitrary scale.

(Structure of the Composite Electric Cable of the Present Invention)

Figure 1:
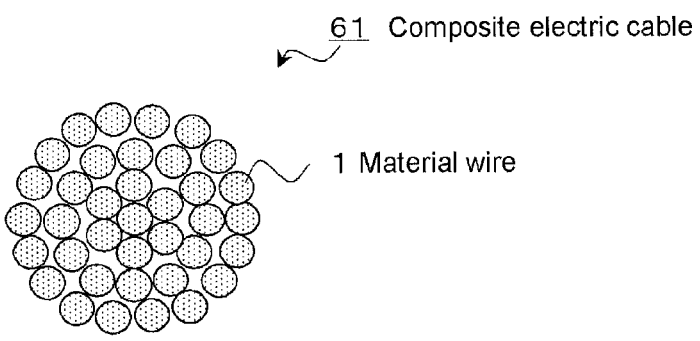
FIG. 1 (*a*) Schematic view of a composite electric cable 61 according to the present invention, (*b*) schematic view of a composite electric cable 63 according to the present invention, (*c*) schematic view of a composite electric cable 67 according to the present invention, and (*d*) schematic view of a composite electric cable 69 according to the present invention.
Figure 1:
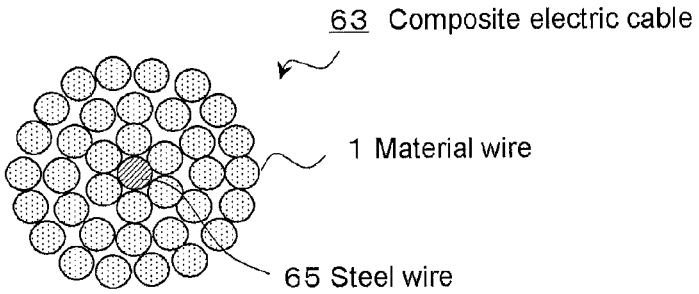
Figure 1:
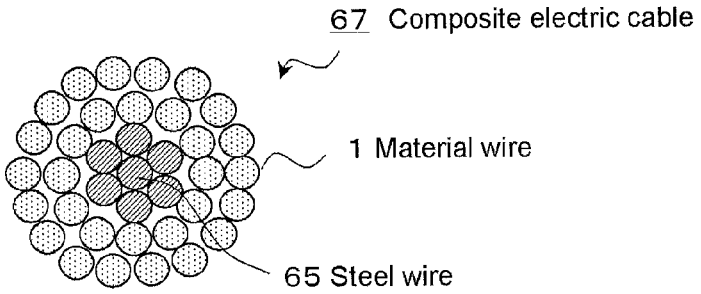
Figure 1:
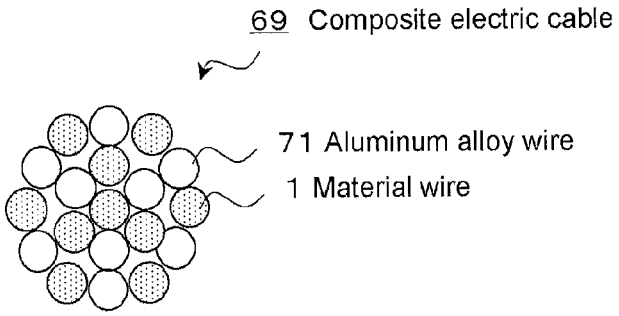

The composite electric cable 61 according to the present invention will be described in detail. As shown in FIG. 1(*a*), the composite electric cable 61 is formed of element wires 1 twisted together, each wire being formed of a composite material comprising an aluminum material and carbon nanotubes dispersed in the aluminum material. In FIG. 1(*a*), the composite electric cable 61 is formed by twisting together 37 material wires 1. However, the number of element wires to be twisted together may be appropriately modified in accordance with the purpose of use of the electric cable.

The composite electric cable 61 is lighter than conventional ACSR and provides a minimum tensile load which is almost equivalent to or higher than that of conventional ACSR. By virtue of such a strength and light weight, the electric cable can be aerially wired with small sag, whereby current capacity can be increased without increasing the height of a transmission line tower.

Alternatively, as shown in FIG. 1(*b*), there may be employed another composite electric cable 63, which is formed by twisting a galvanized steel wire 65 as a center wire together with 36 material wires 1 formed of the composite material.

Through employment of the composite electric cable 63, even in the case where a forest fire occurs under a transmission electric cable to thereby elevate the temperature of the transmission electric cable, breakage of the twisted wires can be prevented by virtue of the presence of the galvanized steel wire serving as a center element wire in case of a fire under an overhead transmission line tower. When a galvanized steel wire is employed as a center element wire, the increase in mass of the electric cable is small. Thus, the electric cable can be aerially wired with a sag smaller than that required for conventional ACSR. As shown in FIG. 1(*c*), there may also be employed a composite electric cable 67, in which 7 galvanized steel wires 65 form a center portion of the twisted wires.

As shown in FIG. 1(*d*), there may also be employed a composite electric cable 69 in which material wires 1 formed of the composite material and aluminum alloy wires 71 containing no carbon nanotube are twisted together. In the composite electric cable 69, the material wires 1 formed of the composite material are used instead of hard aluminum wires and aluminum wires of ACAR, or instead of aluminum alloy wires. Thus, the sag can be reduced, and the cable capacity can be increased, as compared with ACAR.

(Material Wire Formed of the Composite Material of the Present Invention)

A material wire 1 is formed of a composite material comprising an aluminum material and carbon nanotubes dispersed in the aluminum material and has a cellulation structure 7.

(Cellulation Structure)

Figure 2:
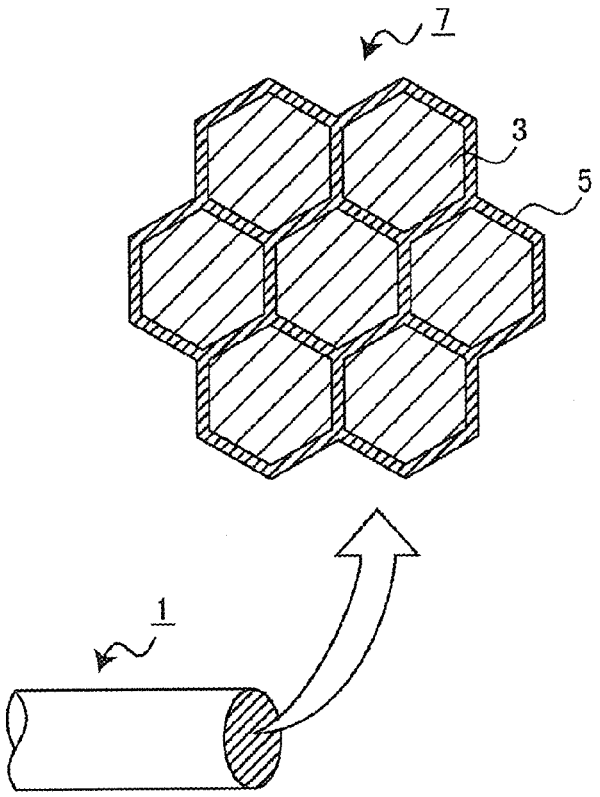
FIG. 2 (*a*) Schematic view of a material wire 1 of the first embodiment, and (*b*) schematic view of another cellulation structure 7*a*.
Figure 2:
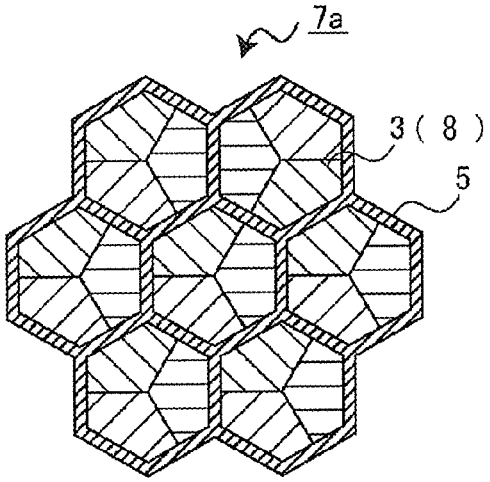

As shown in FIG. 2(*a*), the cellulation structure 7 has a wall portion 5 and an inside portion of the wall 3. The wall portion 5 contains carbon nanotubes, and the inside portion of the wall 3 is formed of an aluminum material and unavoidable impurities. Notably, as shown in FIG. 2(*a*) with an arrow, the upper part of FIG. 2(*a*) is an enlarged schematic view of a part of the cross section of the material wire 1 shown in the lower part of FIG. 2(*a*). The inside portion of the wall 3 has a size in a direction orthogonal to the longitudinal direction of the material wire 1 of 5 μm or less and about 0.3 to about 3 μm. Although all the inside portions of the walls 3 in the drawing have the same size, the sizes of the inside portions of the walls 3 may vary in an actual electric cable. Also, although only seven inside portions of the walls 3 are shown in the drawing, actually, a large number of inside portions of the walls 3 and wall portions 5 are present, to thereby form a large cellulation structure 7. The wall portion of the cellulation structure may correspond to the crystal grain boundary. However, not all the crystal grain boundaries necessarily correspond to the wall portion. The grain may penetrate a wall portion. Furthermore, the grain boundary may be present inside or outside the cellulation structure. Alternatively, as shown in FIG. 2(*b*), there may be employed a cellulation structure 7*a*, in which a part of the inside portion of the wall 3 may be formed of a plurality of crystal grains 8. In the case where the aluminum material particles are polycrystalline particles before sintering, the crystal grains 8 originally contained in the inside portion of the wall 3 are generated from polycrystalline particles or during working. The grain boundary of the crystal grains 8 contains substantially no carbon nanotube.

The cellulation structure 7 has a diameter of 1 to 100 μm and is produced by sintering aluminum material particles on which carbon nanotubes are deposited. Each inside portion of the wall 3 is derived from aluminum material particles through sintering, and each wall portion 5 is derived from the surfaces of the aluminum material particles through sintering.

As viewed in the cross section of the material wire 1 in a direction orthogonal to the longitudinal direction thereof, the material wire 1 preferably has a plurality of similar cellulation structures 7. Also preferably, the inside portion of the wall 3 is long in the longitudinal direction and short in a direction orthogonal to the longitudinal direction; i.e., has a high aspect ratio. For example, the longitudinal direction length of the inside portion of the wall 3 may be longer than that in a direction orthogonal to the longitudinal direction, more preferably about 100-times the length. The wall portion 5 preferably has a generally tubular shape such that the longitudinal direction of the wall portion is approximately parallel to the longitudinal direction of the material wire. The wall portion 5 may have an opening in the longitudinal direction of the material wire 1. The opening may be provided during working (e.g., wire drawing) of the material wire 1 by simultaneously drawing the wall portion 5. The cellulation structure may have a crystal grain boundary in the inside or outside thereof. The refining of the crystal grain size is caused during working (e.g., wire drawing) of the material wire 1. The crystal grain boundary may penetrate the wall portion. The structure may be realized by crystal growth material during working (e.g., annealing) of the material wire 1.

(Textile-Like Structure)

The wall portion 5 may have a textile-like structure formed of a plurality of carbon nanotubes; the textile-like structure encloses the aluminum material originally contained in the inside portion of the wall 3; the carbon nanotubes forming the wall portion 5 are in contact with the aluminum material and are in contact with one another; and the material wire has the cellulation structure in a cross section parallel to the longitudinal direction thereof and in a cross section orthogonal to the longitudinal direction, to thereby form a 3-dimensional cellulation structure. In observation of the cross section of the material wire in a direction parallel to the longitudinal direction, there may be confirmed mobilization mark of unavoidable impurities in the aluminum material during wire drawing.

Preferably, the carbon nanotubes contained in the wall portion 5 have a cross section in a direction orthogonal to the longitudinal direction (i.e., shorter direction) of each carbon nanotube, the cross section of the carbon nanotubes may be deformed or the carbon nanotubes are bent by a stress applied to the carbon nanotube;

or the carbon nanotubes have received both the deformation and bending by a stress applied to the carbon nanotube. In the case where a tensile stress is applied to multi-layer carbon nanotubes only in its longitudinal direction, only the outermost layer of a carbon nanotube receives the applied tensile stress. However, in the case where a stress is applied to a carbon nanotube in its shorter direction, and the cross section in the shorter direction is deformed. In case of a carbon nanotube is bent, when a tensile stress is applied to a carbon nanotube in the longitudinal direction, the stress is received by the outermost layer and inner layers of the carbon nanotube. Thus, the carbon nanotube has resistance to the tensile stress, whereby the tensile strength of the material wire increases.

(Aluminum Oxide Contained in the Wall Portion)

The aluminum oxide concentration of the wall portion 5 is higher than that of the inside portion of the wall 3. This is because the wall portion 5 is derived from the surfaces of sintered aluminum material particles, which surfaces contain aluminum oxide originating from oxide film of the aluminum material.

In the cross section of the material wire 1 orthogonal to the longitudinal direction thereof, a plurality of wall portions 5 forming the cellulation structure 7 are in contact with one another. In the cross section, there is observed a feature that a part of the wall portion 5 has a structure of a circle-like shape including a line, an elliptic structure, a structure of a generally polygonal shape formed by a plurality of lines having different lengths, or a structure of a generally polygonal shape formed by lines having almost the same length. This shape is provided when the aluminum material is softened during sintering of the aluminum material particles, to thereby fill the interparticle spaces with the material, and that is derived from the structure of the aluminum material particles being deformed.

The cross section of the material wire 1 orthogonal to the longitudinal direction exhibits a fractal like structure repeatedly containing a plurality of similar cellulation structures.

(Method for Producing a Billet Having a Cellulation Structure)

The material wire 1 of the present invention is produced by working a billet having a cellulation structure into a material wire. The method for producing the billet comprises a step (a) of mixing an elastomer, aluminum material particles, and carbon nanotubes, to thereby prepare a mixture; a step (b) of heating the mixture so as to vaporize and decompose the elastomer, to thereby prepare a raw material; and a step (c) of sintering the raw material, to thereby form a billet.

Firstly, in the step (a) of mixing an elastomer, aluminum material particles, and carbon nanotubes, to thereby prepare a mixture, the elastomer is mixed with aluminum material particles and carbon nanotubes. No particular limitation is imposed on the method of mixing the elastomer with the above materials, and calender roll mixing, Banbury mixer mixing, or a similar mixing technique may be employed. In a preferred mode, the elastomer (100 parts by mass) is mixed with aluminum material (200 to 1,000 parts by mass) and carbon nanotubes (0.4 to 50 parts by mass). In a particularly preferred mode, the elastomer (100 parts by mass) is mixed with aluminum material (500 parts by mass) and carbon nanotubes (25 parts by mass). The carbon nanotube amount is preferably 0.2 to 5 wt. % with respect to the amount of aluminum material. Notably, a carbon nanotube amount of 1 wt. % with respect to the aluminum material amount means a state that carbon nanotubes (1 part by mass) are added to aluminum material (100 parts by mass).

Next, in the step (b) of heating the mixture so as to vaporize and decompose the elastomer, to thereby prepare a raw material, the mixture is heated in a furnace with an argon gas atmosphere, to thereby obtain a raw material. The heating temperature and time may be such that the used elastomer is sufficiently decomposed. In the case where natural rubber is employed as the elastomer, heating is preferably performed at about 500° C. to about 550° C. for about 2 to about 3 hours. Although argon gas is used as an inert gas, nitrogen or another rare gas may also be used.

In the step (c) of sintering the raw material, to thereby form a billet, the raw material is plasma-sintered to form a billet. Specifically, in one preferred mode, the raw material is placed in an aluminum container, and the raw material being held by the container is placed under generated plasma, to thereby sinter the raw material. Sintering is preferably performed through spark plasma sintering method on the condition of 20 minutes at a maximum temperature of 600° C., a pressure of 50 MPa, and a temperature elevation rate of 40° C./min.

(Elastomer)

Firstly, the elastomer will be described in detail. The elastomer may be selected from natural rubber, synthetic rubber, and thermoplastic elastomer, which have rubber elasticity at room temperature. In the step (b), the elastomer is preferably in a non cross-linked state for suitably decomposing and vaporizing the elastomer by heat. The elastomer preferably has a weight average molecular weight of 5,000 to 5,000,000, more preferably 20,000 to 3,000,000. More preferably, the molecular weight range of the elastomer is narrow, since uniform dispersion state of carbon nanotubes can be attained. When the molecular weight meets the above conditions, elastomer molecules are entangled with one another and mutually linked together. In such a state, the elastomer has an elasticity suitable for dispersing carbon nanotubes. Furthermore, by virtue of viscosity, the elastomer readily enters into spaces between the cohesive carbon nanotubes. Therefore, a higher elasticity is preferred for separating carbon nanotubes from one another.

Examples of the elastomer which may be used in the present invention include elastomers such as natural rubber (NR), epoxidized natural rubber (ENR), styrene-butadiene rubber (SBR), nitrile rubber (NBR), chloroprene rubber (CR), ethylene-propylene rubber (EPR, EPDM), butyl rubber (IIR), chlorobutyl rubber (CIIR), acrylic rubber (ACM), silicone rubber (Q), fluororubber (FKM), butadiene rubber (BR), epoxidized butadiene rubber (EBR), epichlorohydrin rubber (CO, CEO), urethane rubber (U), and polysulfide rubber (T); thermoplastic elastomers such as olefin (TPO), polyvinyl chloride (TPVC), polyester (TPEE), polyurethane (TPU), polyamide (TPEA), and styrene (SBS); and mixtures thereof.

(Aluminum Material Particles)

When at least a portion of carbon nanotubes is incorporated into aluminum material particles, the movement of the carbon nanotubes may be inhibited. In the step (a), when the aluminum material particles are dispersed in the elastomer, subsequent dispersion of carbon nanotubes may be facilitated, to thereby attain a more favorable carbon nanotube dispersion state. The aluminum material particles preferably have a mean particle size greater than that of the carbon nanotubes employed. For example, the mean particle size of the aluminum material particles can be controlled from 1 μm to 100 μm, preferably 10 μm to 50 μm. Notably, in the case of a commercial product of aluminum material particles, the mean particle size thereof may be a nominal particle size specified by the producer, or a number-average particle size measured under an optical microscope or an electron microscope.

The aluminum material employed in the invention is pure aluminum or an aluminum alloy. From the viewpoint of enhancement of mechanical strength and conductivity, the aluminum material particularly preferably a pure aluminum material such as JIS A1070 alloy or JIS A1050 alloy or an Al—Mg—Si material such as JIS A6101 alloy. Generally, an aluminum material ingot contains Fe and Si as unavoidable impurities. The aluminum material may further contain other unavoidable impurities intermingled thereinto in the production step. Such unavoidable impurities include aluminum oxide, which is formed by naturally oxidizing the aluminum material during the production step.

(Carbon Nanotubes)

A carbon nanotube is a single-layer cylindrical structure of a graphene sheet of a hexagonal carbon network having a closed end, or a multi-layer cylindrical structure being displaced as nested single-layer cylindrical structures. That is, the carbon nanotube may have a single-layer structure, a multi-layer structure, or a mixture of single-layer structure and a multi-layer structure.

The carbon nanotubes preferably have a mean diameter of 0.5 to 50 nm. One carbon nanotube may have a straight-line shape or a curved line shape. The mean diameter may be determined by averaging the diameter measurements obtained under an electron microscope. No particular limitation is imposed on the amount of carbon nanotube, and it may be predetermined in accordance with the purpose of use of the end product. Into the material wire of the present invention, carbon nanotubes are incorporated in an amount of 0.2 to 5 wt. % with respect to that of the aluminum material.

The single-layer carbon nanotube or multi-layer carbon nanotube is produced so as to have a desired size through an arc discharge technique, a laser ablation technique, a vapor phase growth technique, or a similar technique.

In the arc discharge technique, arc discharge is caused to occur between carbon rod electrodes under argon or hydrogen at a pressure slightly lower than the atmospheric pressure, whereby multi-layer carbon nanotubes deposited on a negative electrode are recovered.

In this technique, single-layer carbon nanotubes are produced by performing arc discharge between carbon rod electrodes containing a catalyst such as nickel/cobalt and collecting the soot deposited on the inner wall of the reactor.

In the laser ablation technique, the surface of a carbon target containing a catalyst (e.g., nickel/cobalt) is irradiated with an intense pulse laser beam (by YAG laser) in rare gas (e.g., argon), to thereby melt and vaporize the carbon surface, whereby single-layer carbon nanotubes can be produced. In the vapor phase growth technique, a hydrocarbon such as benzene or toluene is pyrolized in vapor phase, to thereby synthesize carbon nanotubes. More specific examples of the technique include a fluidized catalyst technique and a catalyst-on-zeolite technique. Before kneading with elastomer, carbon nanotubes may be subjected in advance to a surface treatment such as ion implantation, sputter-etching, or a plasma treatment, to thereby enhance adhesion to the elastomer and wettability to the elastomer.

Preferably, the carbon nanotubes include carbon nanotubes having a length of 1 μm or shorter and carbon nanotubes having a length of 10 μm or longer, and has a peak in the length region of 1 μm or shorter and a peak in the length region of 10 μm or longer, observed in a length distribution profile thereof. Carbon nanotubes having a length of 1 μm or shorter are readily incorporated into the wall portion 5 so as to form the wall portion 5. Carbon nanotubes having a length of 10 μm or longer, which is greater than the thickness of the wall portion 5, are present in the wall portion 5 and in the inside portion of the wall 3 adjacent thereto, to thereby link a plurality of inside portion of the walls 3, whereby the mechanical strength (e.g., tensile strength) of the cellulation structure 7 can be enhanced.

In other words, in the cellulation structure 7 of the present invention, preferably, the wall portion 5 contains short carbon nanotubes, and a plurality of inside portions of the walls 3 are linked together by the long carbon nanotubes.

The carbon nanotubes of the present invention may include a double-wall carbon nanotube having a cross section of concentric circles, or a deformed double-wall carbon nanotube having a press-compressed cross section. A double-wall carbon nanotube (DWNT) means to be a double-layer carbon nanotube.

(Working Billet to Form Material Wire)

Generally, wire drawing may be performed through working of a raw solid material (plastic working). Plastic working may be performed through extrusion, rolling, drawing, or a similar technique. If needed, these working techniques may be performed in combination.

The material wire of the present invention has a cellulation structure. When the material is subjected to a tensile test, cracks are generated between inside portion of the walls 3. However, since the carbon nanotubes present in the wall portion 5 link the inside portion of the walls 3, the material wire itself is thought to be prevented from breaking until the carbon nanotubes are drawn from the inside portion of the walls 3. In other words, conceivably, excessive force is required for drawing carbon nanotubes; i.e., for causing the material to break, resulting in enhancement in tensile strength. Also, since a carbon nanotube itself is resistant to plastic deformation, carbon nanotubes migrate in aluminum material accompanied by elastic deformation during deformation of the billet.

(Method for Producing Material Wire Through Extrusion)

Figure 3:
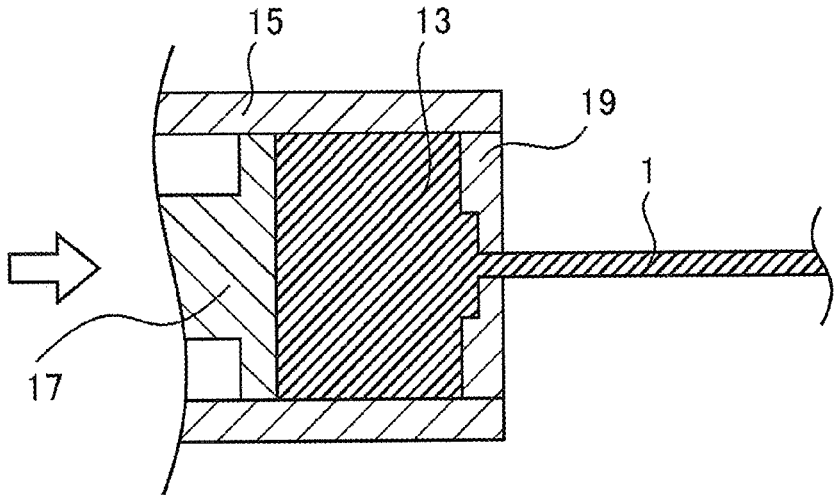
FIG. 3 Production method of the material wire according to the present invention of being used extrusion forming.

As shown in FIG. 3, in the method for producing a material wire through extrusion, a billet 13 is inserted into a container 15, and the billet 13 is pressed by means of a ram 17, to thereby extrude the billet through a die 19, whereby a material wire 1 is produced. The die 19 has an opening having a wide inlet and a narrow outlet, and the size of the die 19 on the outlet side is equivalent to the size of the material wire 1. Since large tension may be applied to the billet 13, the reduction in cross section in one working operation may be decreased for preventing breakage of the material wire 1. Therefore, in a preferred mode, extrusion operation is repeated several times for producing a thin material wire, through stepwise extrusion of a thick billet. The billet 13 may be hot-extruded at about 500° C. Generally, hot extrusion is performed to allow reduction in deformation resistance and to improve deformability of the billet under heating.

Figure 4:
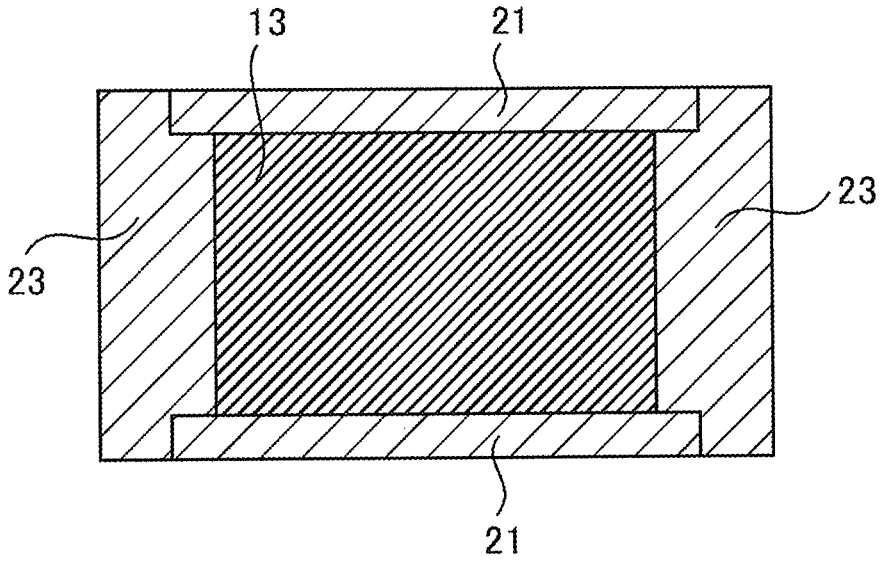
FIG. 4 (*a*) Cross sectional schematic view of a billet suitable for extrusion, and (*b*) cross sectional schematic view of a billet to be extruded.
Figure 4:
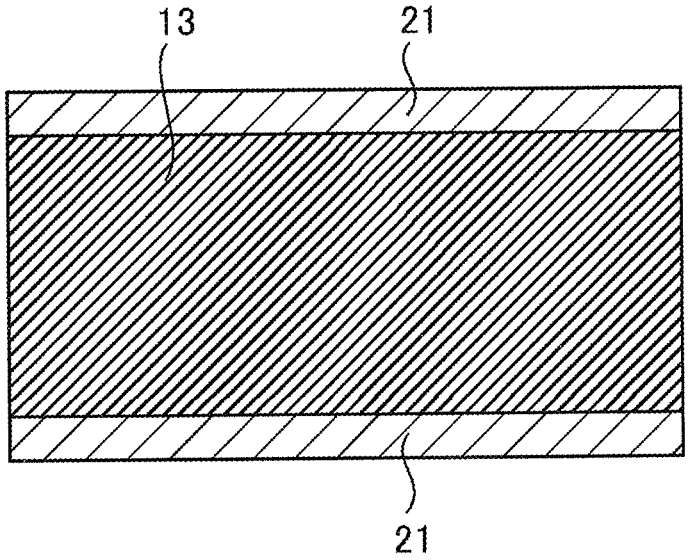

Preferably, the peripheral part of the extrusion billet 13 is coated with a cladding member 21 made of aluminum material as shown in FIG. 4(*b*), and each of the front and rear ends of the billet 13 is capped with a lid member 23 made of aluminum material as shown in FIG. 4(*a*). Through attaching the lid member 23 to each of the front and rear ends of the billet 13, there may be prevented cracking attributed to additional shear stress applied to the interface between the wall portion and aluminum material, which would otherwise be caused by non-uniform metal flow of the material wire when the tip of the extrusion material is extruded through the opening of the die.

The billet to be extruded is made of JIS A6101 alloy and, before extrusion, the billet is subjected to a homogenization treatment for homogenizing the metallographic structure, and followed by extrusion. An alloy material such as JIS A6101 alloy is required to be subjected to a homogenization treatment. Homogenization must be performed at about 530 to 560° C. for about 6 hours. Alternatively, indirect extrusion, which attains relatively stable metal flow, may also be employed.

Instead of extrusion, hot forging may be performed. In hot forging, the billet is heated to almost the same temperature as employed in extrusion. In the case of forging, cracking generates when the reduction ratio in one working operation increases. Therefore, forging is performed repeatedly, to thereby reduce the cross section of the billet.

(Method for Producing Material Wire Through Drawing)

Figure 5:
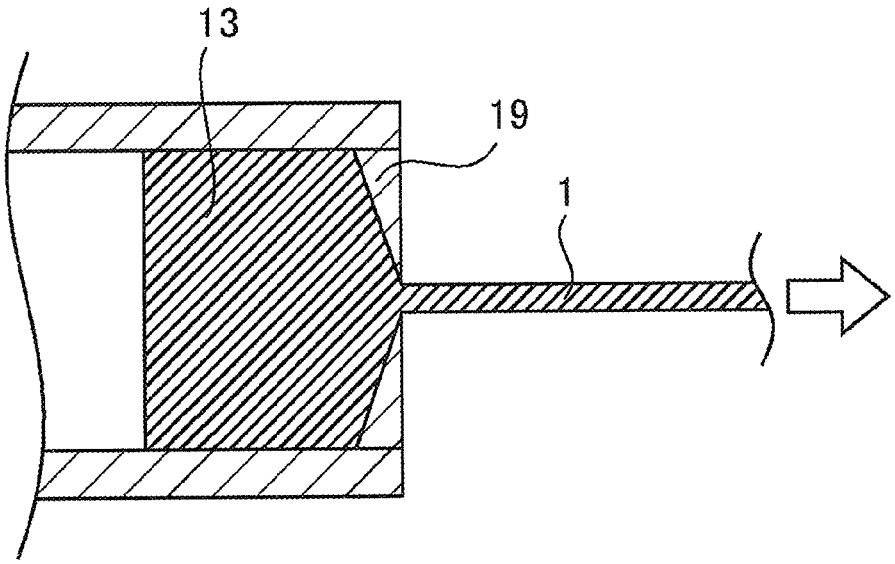
FIG. 5 Production method of the material wire according to the present invention of being used drawing.

As shown in FIG. 5, in the method for producing a material wire through drawing, a billet 13 is pressed to a die 19, and the billet 13 is drawn through the hole of the die 19, to thereby produce a material wire 1. The billet 13 is drawn by winding the material wire 1 over a drum (not illustrated). Similar to the case of extrusion, reduction in cross section in one drawing operation is limited. Therefore, in order to produce a thin material wire, preferably, drawing is performed repeatedly, while the working ratio is maintained at a low level. In the case where drawing is performed repeatedly, preferably, a heat treatment called intermediate annealing is intervened between drawing operations, to thereby relieve work strain. In one drawing mode, a cemented carbide die is employed as the die 19, and a mineral oil having a viscosity as high as some thousands to 20,000 cSt (40° C.) is used as a lubricant. In addition to the liquid lubricant, a solid lubricant (e.g., molybdenum disulfide) or an oiliness improver (e.g., oleic acid or stearic acid) may be added, to thereby enhance lubricity. Alternatively, a metal soap such as calcium stearate may also be used.

(Method for Producing Material Wire Through Combination of Various Working Techniques)

In the production of a material wire, working operations such as extrusion, rolling, drawing, etc. may be performed in combination. Generally, in the most preferred mode, a billet is firstly worked through hot extrusion, since a large reduction ratio can be employed. After production of a billet having a smaller diameter, working by rolling or drawing is performed. In some cases, hot rolling or cold rolling is expected to be performed instead of extrusion, and then drawing is performed. When rolling is performed after hot extrusion, the extruded material wire can be rolled as it is, since the outer peripheral portion of the material wire is coated with aluminum material. In this case, if the deformation texture is sufficiently developed by hot extrusion, cold rolling may be performed instead of hot rolling. Before rolling or drawing, in the case of hot-extrusion material, both lid portions of the billet and portions in the vicinity of the lid potions where metal flow is unstable must be cut off, and a portion of the material wire having a uniform cross section must be rolled or drawn.

Notably, instead of hot extrusion, hot forging may be performed a plurality of times, followed by rolling or drawing.

Second Embodiment

The second embodiment will next be described.

Figure 6:
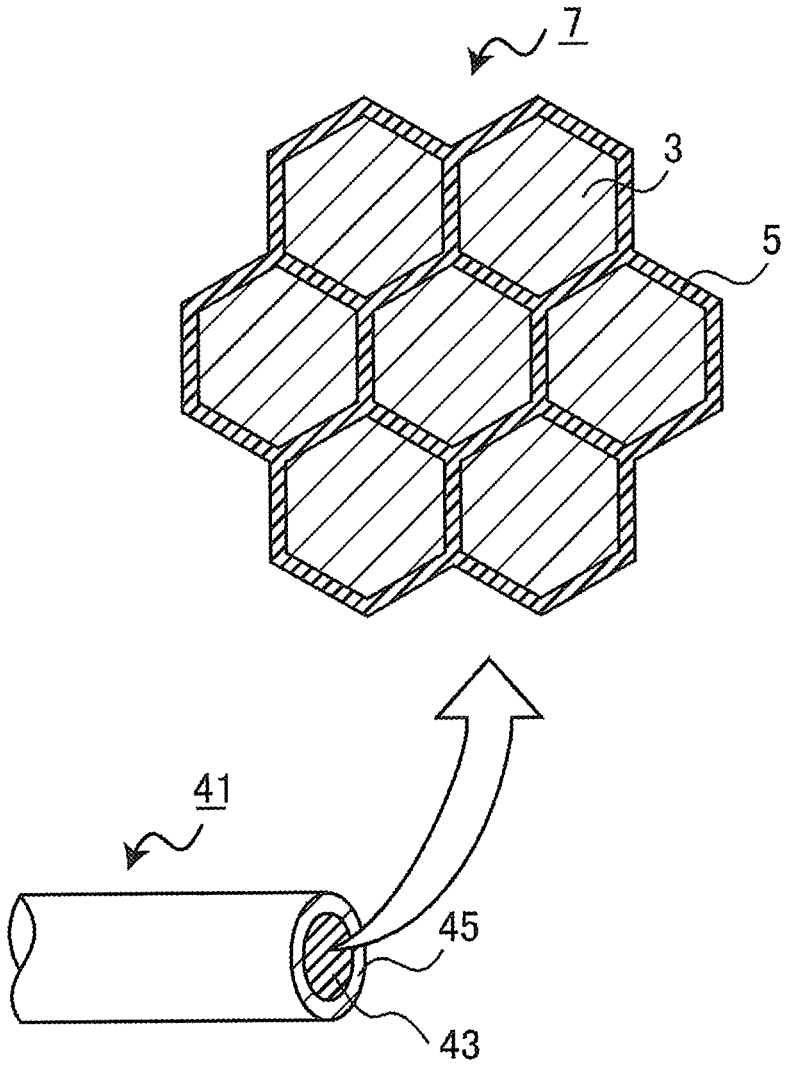
FIG. 6 Schematic view of a material wire 41 of the second embodiment.

FIG. 6 is a schematic view of a material wire 41 of the second embodiment. In the second embodiment, the same members as employed in the first embodiment are denoted by the same reference numerals, and overlapped descriptions are omitted. Notably, as shown in FIG. 6 with an arrow, the upper part of FIG. 6 is an enlarged schematic view of a part of the cross section of the core portion 43 shown in the lower part of FIG. 6.

The material wire 41 includes the core portion 43 and a clad portion 45, the core portion 43 containing carbon nanotubes and having the cellulation structure 7, and the clad portion 45 containing no carbon nanotube or having a carbon nanotube concentration lower than that of the core portion 43 and having no cellulation structure 7.

In the material wire 41, the core portion 43, having a cellulation structure, is difficult to undergo wire drawing, whereas the clad portion 45 having no cellulation structure, is easy to undergo wire drawing. The clad portion, which receives friction force with a working tool, is preferably coated with an aluminum material having no cellulation structure and excellent workability. During wire drawing, compressive stress (inwardly to the center of the cross section of a material wire) and shear stress are applied to the material wire. Thus, when force is applied to the material wire in the axis direction thereof, both a force component orthogonal to the axis direction of the material wire and shear force generate. Therefore, the material wire 41 is suited to plastic working.

The material wire 41 is produced through plastic working of a sintered product having an aluminum outer surface. Such a sintered product may be produced by adding aluminum particles covered with carbon nanotubes (raw material after heat treatment) to an aluminum container in which aluminum material particles have been already placed, and subjecting the aluminum container to sintering. The aluminum material particles are placed in the aluminum container such that the particles cover the raw material and are in contact with the inner surface of the container. By doing this mode, a billet in which the carbon nanotube-containing region is covered with the region containing substantially no carbon nanotube can be produced. By use of the billet in the material wire production method (in particular rolling), the material wire 41 can be produced. The thus-produced billet may be subjected to further heat treatment or thermal working.

In an alternative example of the second embodiment, the material wire 41 may be coated with an aluminum material containing carbon nanotubes and having a cellulation structure. According to this mode, a material wire in which a region having the cellulation structure 7 and a region having no cellulation structure 7 are alternately and concentrically arranged can be produced.

Third Embodiment

Figure 7:
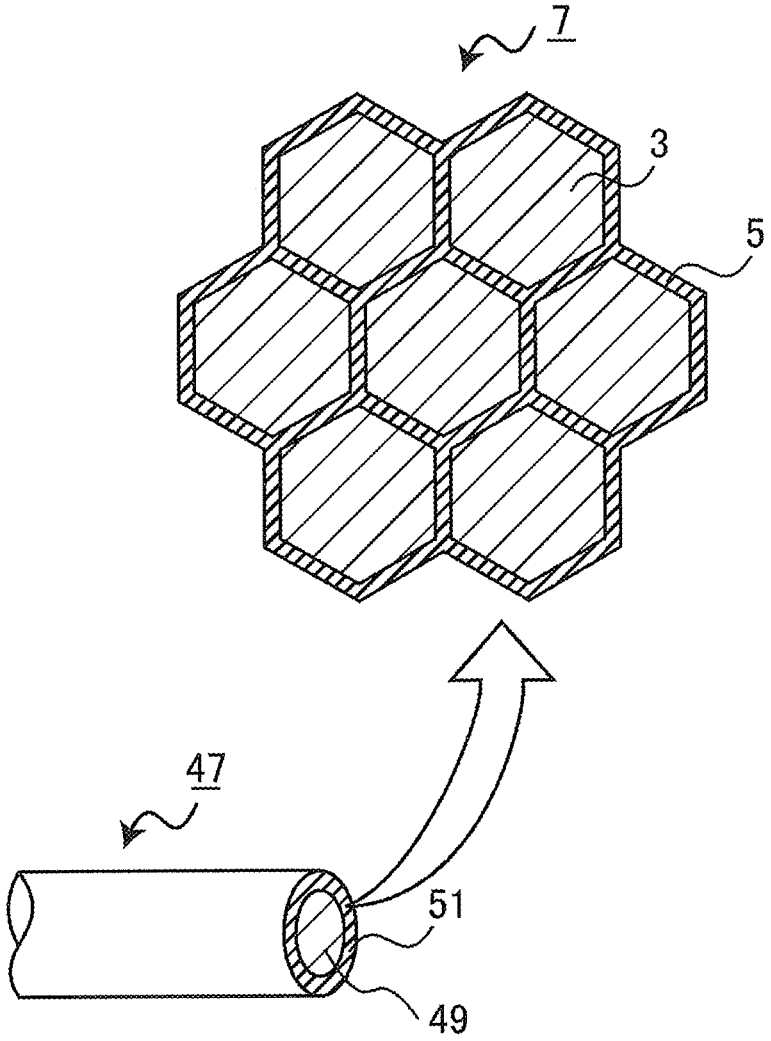
FIG. 7 Schematic view of a material wire 47 of the third embodiment.

The third embodiment will next be described. FIG. 7 is a schematic view of a material wire 47 of the third embodiment. Notably, as shown in FIG. 7 with an arrow, the upper part of FIG. 7 is an enlarged schematic view of a part of the cross section of the clad portion 51 shown in the lower part of FIG. 7.

The material wire 47 includes the clad portion 51 and a core portion 49, the clad portion 51 containing carbon nanotubes and having the cellulation structure 7, and the core portion 49 containing no carbon nanotube or having a carbon nanotube concentration lower than that of the clad portion 51 and having no cellulation structure 7.

Figure 8:
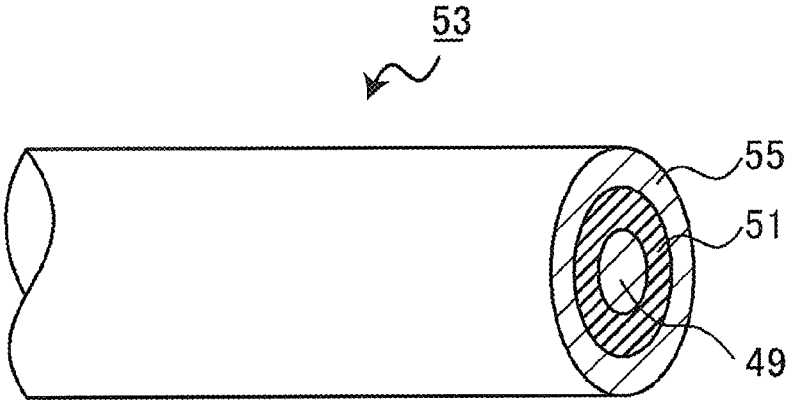
FIG. 8 Schematic view of a material wire 53 (another example) of the third embodiment.

An alternative example of the third embodiment is a material wire 53 shown in FIG. 8. As shown in FIG. 8, the clad portion 51 may be further coated with a coating part 55. The coating part 55 is formed of an aluminum material having no cellulation structure. According to this mode, the material wire 53 has a region having no cellulation structure 7 and a region having the cellulation structure 7 which are alternately and concentrically arranged. The coating part 55 may be produced through vapor deposition of aluminum. The thus-produced concentric structure may be subjected to further heat treatment or thermal working (i.e., forging).

(Characteristics of the Material Wire of the Present Invention)

The material wire of the present invention, when the base material thereof is pure aluminum, preferably has a break strength, compressive strength, tensile strength, linear expansion coefficient, melting temperature, and bending strength which are equivalent to or higher than those of pure aluminum and has an electrical conductivity 90% or higher that of pure aluminum. Specifically, the material wire preferably has a tensile strength of 70 MPa or more, a linear expansion coefficient of $24\times10^{-6}$/° C. (20° C. to 100° C.) or less, and a melting temperature of 650° C. or higher. The material wire preferably has an electrical conductivity of 56 IACS % or more. When the base aluminum is an aluminum alloy containing Si and Mg, the material wire preferably has the above properties on the basis of the aluminum alloy, but other properties are the same as those of the material wire made of pure aluminum.

Furthermore, in consideration of the use of electric cables, the material wire of the present invention preferably has a tensile strength of 150 MPa or more and a linear expansion coefficient of $10\times10^{-6}$/K or less (293 K), with a tensile strength of 200 to 600 MPa being more preferred.

The carbon nanotubes contained in the material wire of the present invention preferably have a length in the longitudinal direction is 1/1,000 or less the diameter of the material wire.

The inside portion of the wall 3 preferably has a length in the longitudinal direction is 1/1,000 or less the diameter of the material wire. When the inside portion of the wall 3 has an excessively large size, sufficient numbers of inside portions of the walls 3 cannot be disposed in a direction orthogonal to the longitudinal direction of the material wire, failing to form a cellulation structure.

The material wire 1 preferably has a diameter of 50 μm to 1 cm and a length/diameter ratio of 100 or more.

The surface of the material wire 1 may be plated with a metal other than aluminum. The plating on the surface of the material wire 1 may be performed through any of hot dip plating, electroplating, vapor deposition, and similar techniques.

The composite electric cables 61, 63, 67, and 69, which employ the material wires 1 as element wires, may be further coated with resin.

Suitable embodiments of the present invention have been described with reference to the drawings. However, the present invention is not limited to these embodiments. It is apparent that those skilled in the art can conceive various modifications and variations within the technical concept disclosed in the specification. It is also understood that the scope of the present invention also includes such modifications and variations.

EXAMPLES

The present invention will next be described in detail by way of examples, which should not be construed as limiting the invention thereto.

Example 1

Production of a Billet Having a Cellulation Structure

Step (a):

Natural rubber (100 g, 100 parts by mass) was fed to a gap between 6-inch open rollers (roller temperature: 10 to 20° C.) so that the rubber covered the rollers. To the natural rubber covering the rollers, aluminum particles (500 parts by mass) as metal particles were fed, and the rubber and the aluminum particles were kneaded. The roller gap was adjusted to 1.5 mm. Subsequently, carbon nanotubes (25 parts by mass, 5 wt. % with respect to aluminum material) were fed to the open rollers. The mixture was removed from the rollers, to thereby yield a mixture of the elastomer, aluminum material powder, and carbon nanotubes.

In Example 1, natural rubber was used as the elastomer, pure aluminum (JIS A1050, mean particle size: 50 μm) was used as the aluminum material powder, and multi-layer carbon nanotubes (mean diameter: 13 nm, product of ILJIN) were used as the carbon nanotubes.

Step (b):

The mixture obtained in step (a) was placed in a furnace under nitrogen and heated at a temperature equal to or higher than the decomposition/vaporization temperature of the elastomer (500° C.) for two hours, to thereby decompose and vaporize the elastomer, whereby a porous raw material was yielded.

Step (c):

The raw material obtained in step (b) was placed in an aluminum cylindrical can (diameter: 40 mm), and the raw material in the can was subjected to spark plasma sintering. The sintering was performed at a maximum temperature of 600° C. for 20 minutes, a pressure of 50 MPa, and a temperature elevation rate of 40° C./min. Through sintering, a columnar billet having a diameter of 40 mm was yielded.

Figure 9:
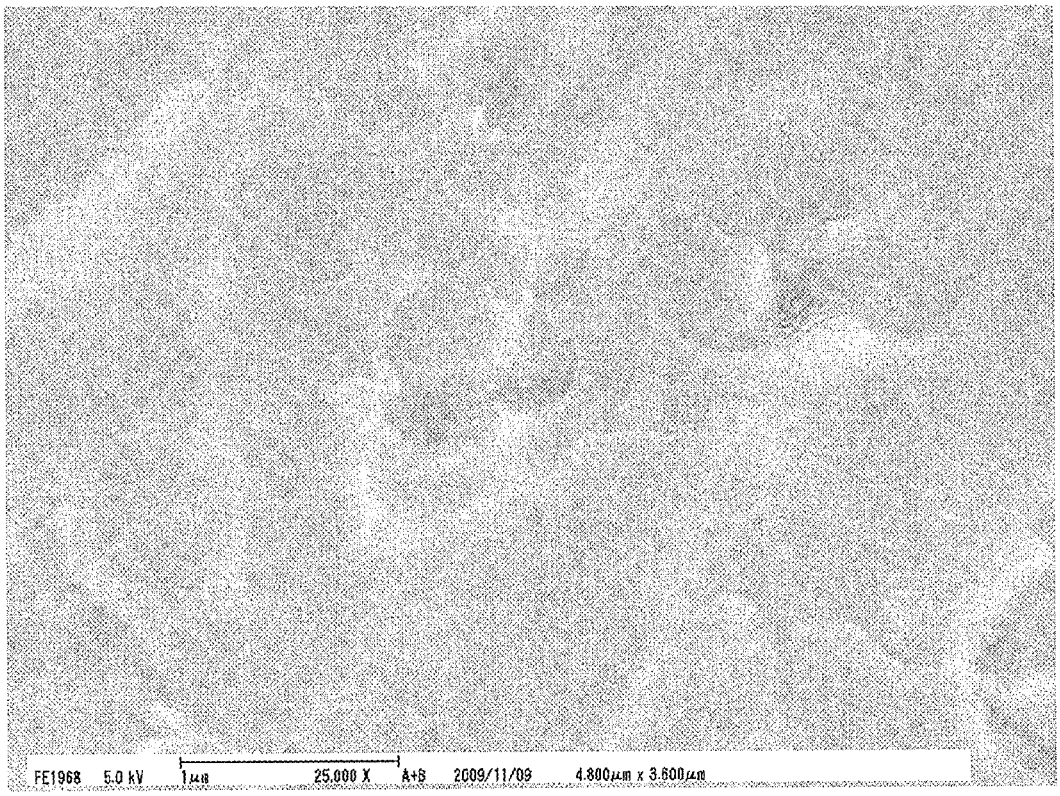
FIG. 9 Scanning electron microscopic (SEM) image of a cross section billet of Example 1.

A cross section of the thus-obtained billet was mechanically polished and etched with argon plasma (400 V) for 20 minutes, and the surface was observed under an electron microscope (SEM). FIG. 9 shows the image. Through etching, a hard portion containing carbon nanotubes remained, and a soft portion containing no carbon nanotube was etched. In the image of FIG. 9, a light color portion (ridge) corresponds to the wall portion 5, and a deep color portion corresponds to the inside portion of the wall 3. As is clear from the image, the billet produced in Example 1 was found to have the cellulation structure 7.

The thus-obtained columnar billet (diameter: 40 mm) was extruded, to thereby produce a material wire (diameter: 10 mm), and the wire was rolled by means of a V-groove roller. The rolled product was annealed at 500° C. for 120 minutes, to thereby yield a material wire (5 mm), which was drawn to produce a material wire having a predetermined size (2 mm).

Example 2

The procedure of Example 1 was repeated, except that aluminum alloy (JIS A6101) particles (mean particle size: 50 μm) were used as an aluminum material powder, to thereby produce a material wire.

(Evaluation of Material Wire)

The tensile strength of the material wire was measured by use of a material wire (wire diameter: 2 mm) in accordance with JIS 22241 (n=3). The results of measurements were averaged.

The electrical conductivity of the material wire was measured by use of a material wire (wire diameter: 2 mm) which was placed in a thermostat bath maintained at 20° C. (±0.5° C.) through the 4-terminal method. From the measured specific resistance, conductivity was calculated. The inter-terminal distance was adjusted to 100 mm.

Table 1 shows the characteristics of the material wires. The material wires of Comparative Examples 1 and 2 were JIS A 1050-0 and JIS A 6101-T6. The tensile strength and electrical conductivity thereof are cited from aluminum material property database (provided by Japan Aluminium Association, http://metal.matdb.jp/JAA-DB/AL00S0001.cfm).

TABLE 1

| | Al material | Carbon nanotubes/Al material (wt. %) | Tensile strength (MPa) | Conductivity (IACS %) |
|---|---|---|---|---|
| Ex. 1 | JIS A1050 | 5 | 90 | 62 |
| Ex. 2 | JIS A6101 | 5 | 235 | 60 |
| Comp. Ex. 1 | JIS A1050-O | 0 | 75 | 61 |
| Comp. Ex. 2 | JIS A6101-T6 | 0 | 220 | 57 |

As is clear from Table 1, the material wire of Example 1 exhibited a tensile strength and a conductivity higher than those of the wire of Comparative Example 1 (JIS A 1050-0).

The material wire of Example 2 exhibited a tensile strength and a conductivity higher than those of the wire of Comparative Example 2 (JIS A 6101-T6).

Thus, the material wire of the present invention was found to be a material which realizes high tensile strength and high conductivity.

Example 3

Step (a)

Natural rubber (100 g, 100 parts by mass) was fed to a gap between 6-inch open rollers (roller temperature: 10 to 20° C.) so that the rubber covered the rollers. To the natural rubber covering the rollers, aluminum particles (500 parts by mass) as metal particles were fed, and the rubber and the aluminum particles were kneaded. The roller gap was adjusted to 1.5 mm. Subsequently, carbon nanotubes (5 parts by mass, 1 wt. % with respect to aluminum material) were fed to the open rollers. The mixture was removed from the rollers, to thereby yield a mixture of the elastomer, aluminum material powder, and carbon nanotubes.

As is used in Example 1, natural rubber was used as the elastomer, aluminum particles produced through atomizing were used as the aluminum material powder. Further multi-layer carbon nanotubes (mean diameter: 55 nm, length: 20 μm, product of Hodogaya Chemical Co., Ltd.) were used as the carbon nanotubes.

Step (b)

The mixture obtained in step (a) was placed in a furnace under nitrogen and heated at a temperature equal to or higher than the decomposition/vaporization temperature of the elastomer (500° C.) for two hours, to thereby decompose and vaporize the elastomer, whereby a porous raw material was yielded.

Step (c)

The raw material obtained in step (b) was placed in an aluminum cylindrical can (diameter: 40 mm), and the raw material in the can was subjected to spark plasma sintering. The sintering was performed at a maximum temperature of 600° C. for 20 minutes, a pressure of 50 MPa, and a temperature elevation rate of 40° C./min. Through sintering, a columnar billet having a diameter of 40 mm was yielded.

The thus-obtained columnar billet (diameter: 40 mm) was extruded, to thereby produce a material wire (diameter: 10 mm), and the wire was rolled by means of a V-groove roller. The rolled product was annealed at 500° C. for 120 minutes, to thereby yield a material wire (5 mm), which was cold-drawn to produce a material wire having a predetermined size (2 mm).

Then, the tensile strength of the material wire was determined in a manner similar to that employed in Example 1.

Examples 4 and 5

The procedure of Example 3 was repeated, except that carbon nanotubes were added in an amount of 15 parts by mass (3 wt. % with respect to aluminum material) or 25 parts by mass (5 wt. % with respect to aluminum material), to thereby produce a material wire.

Example 6

The procedure of Example 3 was repeated, except that multi-layer carbon nanotubes (mean diameter: 2 nm, length: 1.9 μm, product of Thomas Swan & Co., Ltd.) were used, to thereby produce a material wire. The used carbon nanotubes had undergone dispersion treatment before step (a).

Examples 7 and 8

The procedure of Example 6 was repeated, except that carbon nanotubes were added in an amount of 15 parts by mass or 25 parts by mass, to thereby produce a material wire.

Example 9

The procedure of Example 6 was repeated, except that carbon nanotubes were not subjected to dispersion treatment before step (a), to thereby produce a material wire.

Examples 10 and 11

The procedure of Example 9 was repeated, except that carbon nanotubes were added in an amount of 15 parts by mass or 25 parts by mass, to thereby produce a material wire.

Table 2 shows the characteristics of the material wires. As Comparative Example 3, the tensile strength of hard aluminum wire (JIS C 3108) is cited.

TABLE 2

| | Carbon nanotube | Carbon nanotubes/Al material (wt. %) | Tensile strength (MPa) |
|---|---|---|---|
| Ex. 3 | Hodogaya Chemical | 1 | 260 |
| Ex. 4 | Hodogaya Chemical | 3 | 350 |

TABLE 2-continued

| | Carbon nanotube | Carbon nanotubes/Al material (wt. %) | Tensile strength (MPa) |
|---|---|---|---|
| Ex. 5 | Hodogaya Chemical | 5 | 370 |
| Ex. 6 | Thomas Swan (dispersion) | 1 | 260 |
| Ex. 7 | Thomas Swan (dispersion) | 3 | 400 |
| Ex. 8 | Thomas Swan (dispersion) | 5 | 420 |
| Ex. 9 | Thomas Swan (no dispersion) | 1 | 320 |
| Ex. 10 | Thomas Swan (no dispersion) | 3 | 420 |
| Ex. 11 | Thomas Swan (no dispersion) | 5 | 500 |
| Comp. Ex. 3 | — | 0 | 160 |

As is clear from Table 2, according to the present invention, a material wire exhibiting a tensile strength 1.5 to 3 times that of a conventional hard aluminum wire was produced.

The material wire of Example 11 was found to have a linear expansion coefficient of $2.2\times10^{-6}$/K (as measured at 293 K), which is 1/10 the linear expansion coefficient of aluminum.

Figure 10:
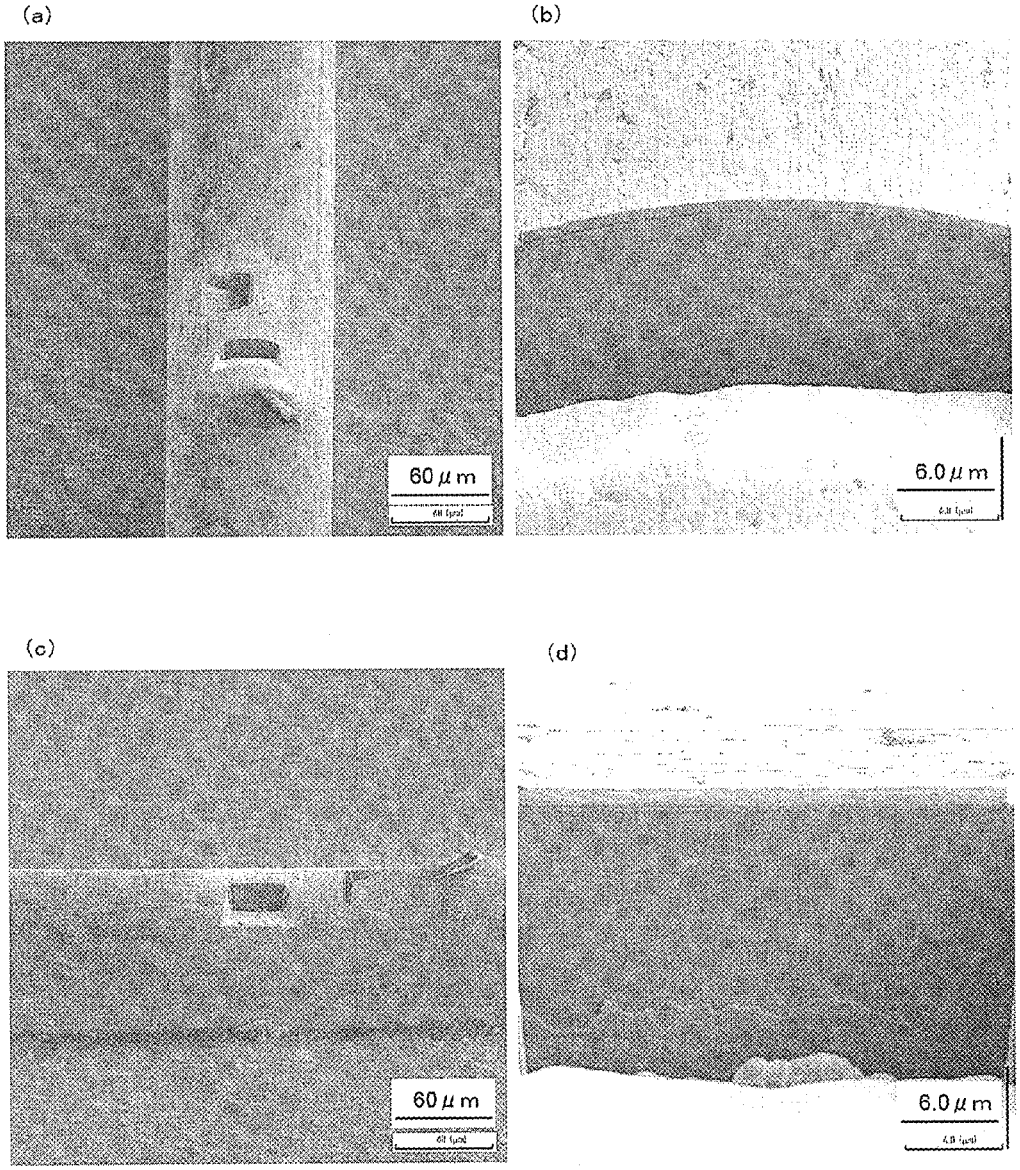
FIG. 10 (*a*) SEM image of a material wire of Example 3, (*b*) SEM image of the material wire of Example 3 (cross section orthogonal to the longitudinal direction), (*c*) SEM image of the material wire of Example 3, and (*d*) SEM image of the material wire of Example 3 (cross section parallel to the longitudinal direction).
Figure 11:
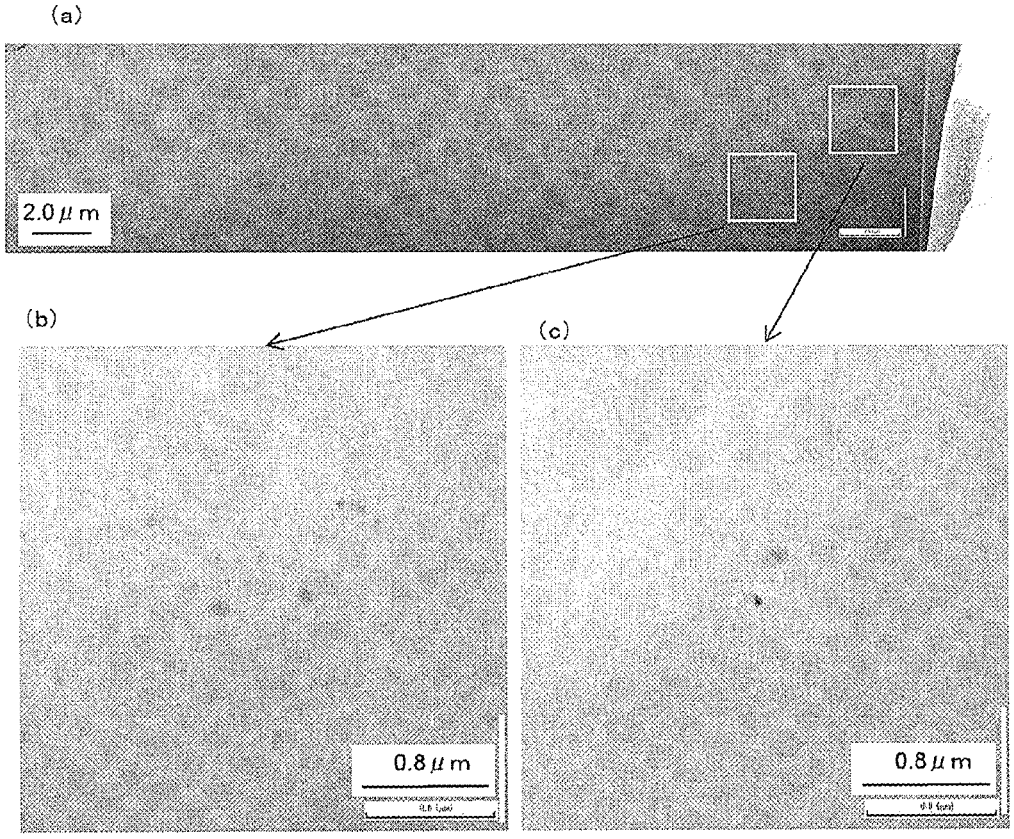
FIG. 11 (*a*) High-magnification SEM image of the material wire of Example 3 (cross section orthogonal to the longitudinal direction), (*b*) higher-magnification SEM image of (*a*), and (*c*) further higher-magnification SEM image of (*a*).
Figure 12:
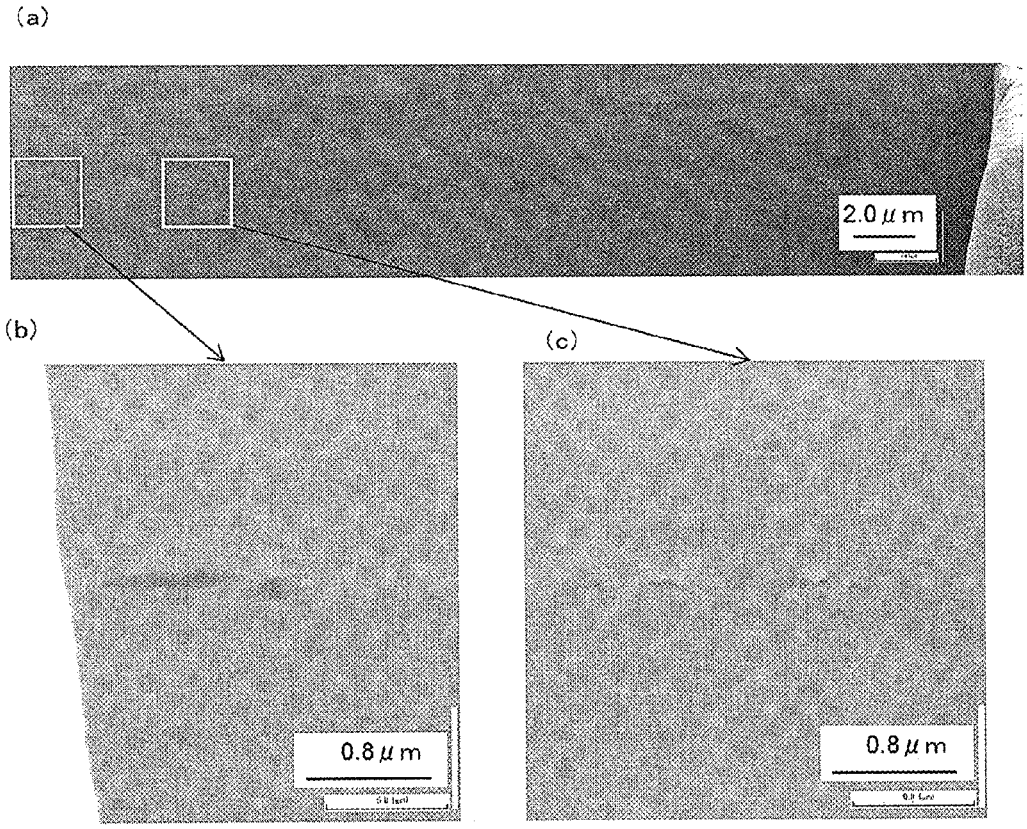
FIG. 12 (*a*) High-magnification SEM image of the material wire of Example 3 (cross section parallel to the longitudinal direction), (*b*) higher-magnification SEM image of (*a*), and (*c*) further higher-magnification SEM image of (*a*).

The material wire of Example 3 was partially cut with focused ion beam, and cut cross sections were observed under an SEM (FIGS. 10 to 12). The observation angle was 55°, and the acceleration voltage was 3 kV. FIG. 10(*a*) is a low-magnification image, and FIG. 10(*b*) is a high-magnification image of a cross section of the material wire in a direction orthogonal to the longitudinal direction thereof. FIG. 10(*c*) is a low-magnification image, and FIG. 10(*d*) is a high-magnification image of a cross section of the material wire in a direction parallel to the longitudinal direction thereof An enlarged image of FIG. 10(*b*) is shown in FIG. 11(*a*). Enlarged observed images of the areas enclosed by squares in FIG. 11(*a*) are shown in FIGS. 11(*b*) and 11(*c*). As is clear from FIG. 11(*a*), a large number of crystal grains having a diameter of about 0.3 to 3 μm were found to be aggregated and form a cellulation structure. In FIGS. 11(*b*) and 11(*c*), black spots correspond to aggregated carbon nanotubes.

An enlarged image of FIG. 10(*d*) is shown in FIG. 12(*a*). Enlarged observed images of the areas enclosed by squares in FIG. 12(*a*) are shown in FIGS. 12(*b*) and 12(*c*). As is clear from FIG. 12(*a*), crystal grains having a length of 10 to 30 μm were observed. From the results and the observation results of FIG. 10(*a*), a large number of aluminum alloy columns having a diameter of about 0.3 to about 3 μm and a length of about 10 to about 30 μm form a material wire. In FIGS. 12(*b*) and 12(*c*), black spots correspond to aggregated carbon nanotubes.

Figure 13:
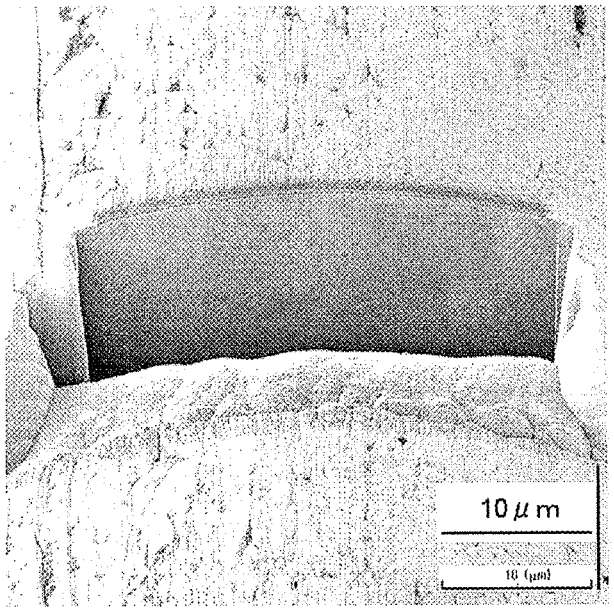
FIG. 13 (*a*) Scanning ion microscopic (SIM) image of a material wire of Example 3, (*b*) SIM image of the material wire of Example 3 (cross section orthogonal to the longitudinal direction).
Figure 13:
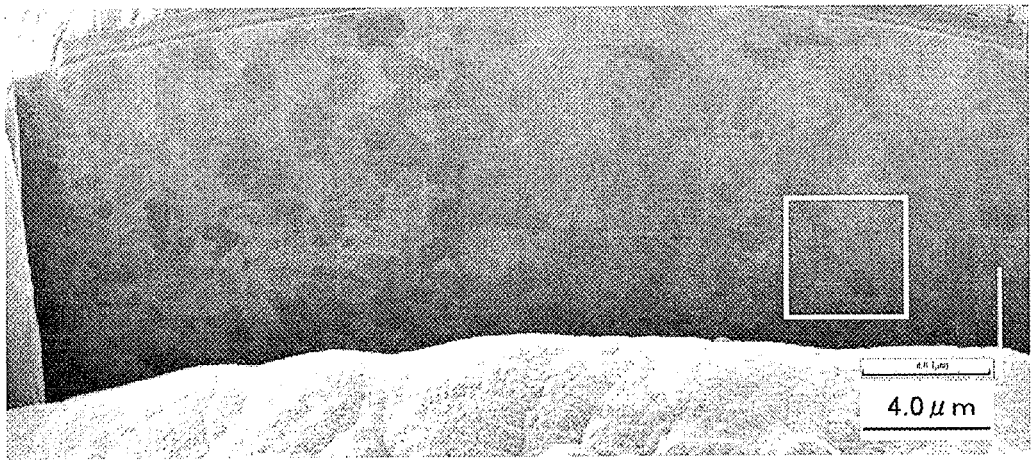
Figure 14:
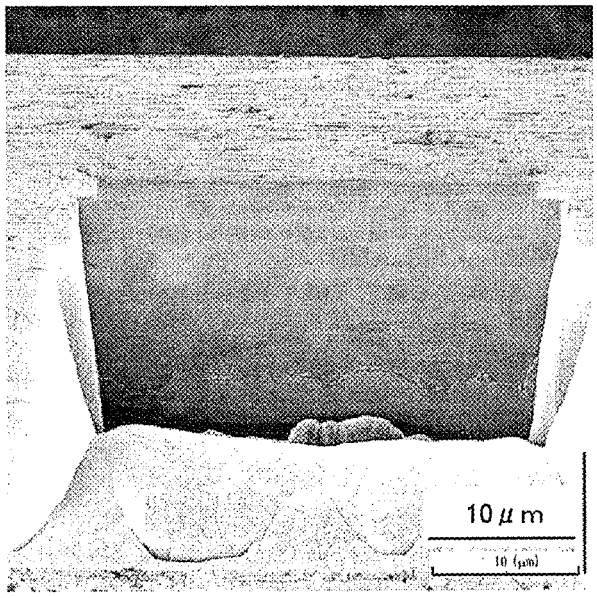
FIG. 14 (*a*) SIM image of a material wire of Example 3, (*b*) SIM image of the material wire of Example 3 (cross section parallel to the longitudinal direction).
Figure 14:
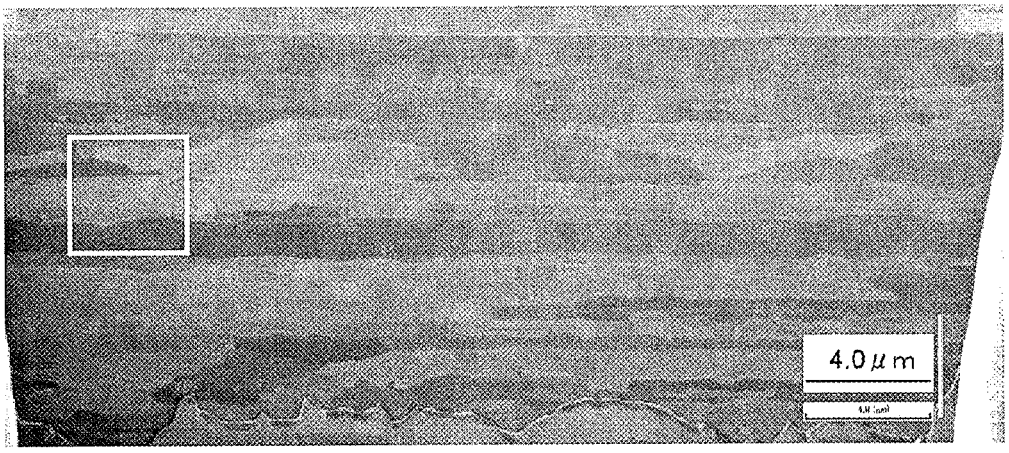

FIGS. 13 and 14 are scanning ion microscopic (SIM) images of the material wire of Example 3 at the same observation areas shown in FIG. 10. FIG. 13(*a*) is a low-magnification image, and FIG. 13(*b*) is a high-magnification image of a cross section of the material wire in a direction orthogonal to the longitudinal direction thereof. FIG. 14(*a*) is a low-magnification image, and FIG. 14(*b*) is a high-magnification image of a cross section of the material wire in a direction parallel to the longitudinal direction thereof. As compared with SEM, SIM allows surface observation selective to a very top surface, since secondary electrons present in a surface portion from the top surface to some tens of nanometers in the thickness direction. Therefore, the cellulation structure at the surface of a cross section of the material wire can be clearly observed.

Figure 15:
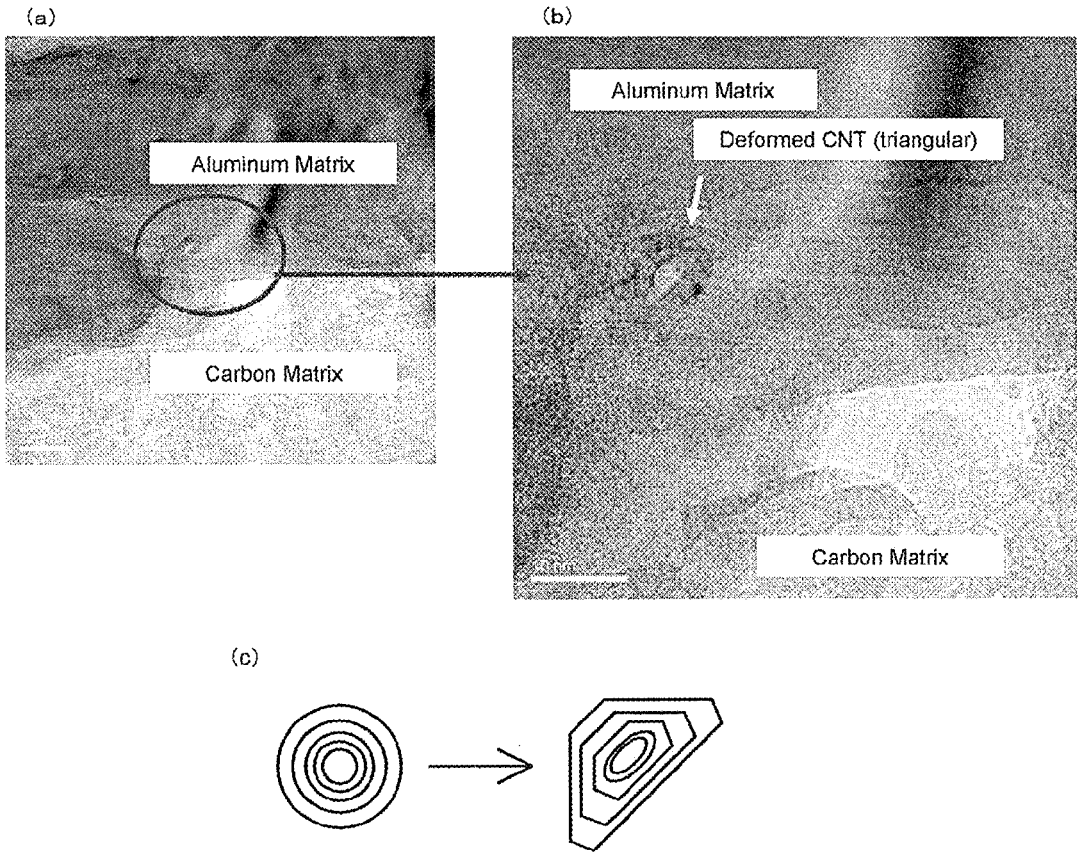
FIG. 15 (*a*) Transmission electron microscopic (TEM) image of a material wire of Example 3, (*b*) higher-magnification TEM image of (*a*), and (*c*) a schematic view showing deformation of carbon nanotube.
Figure 16:
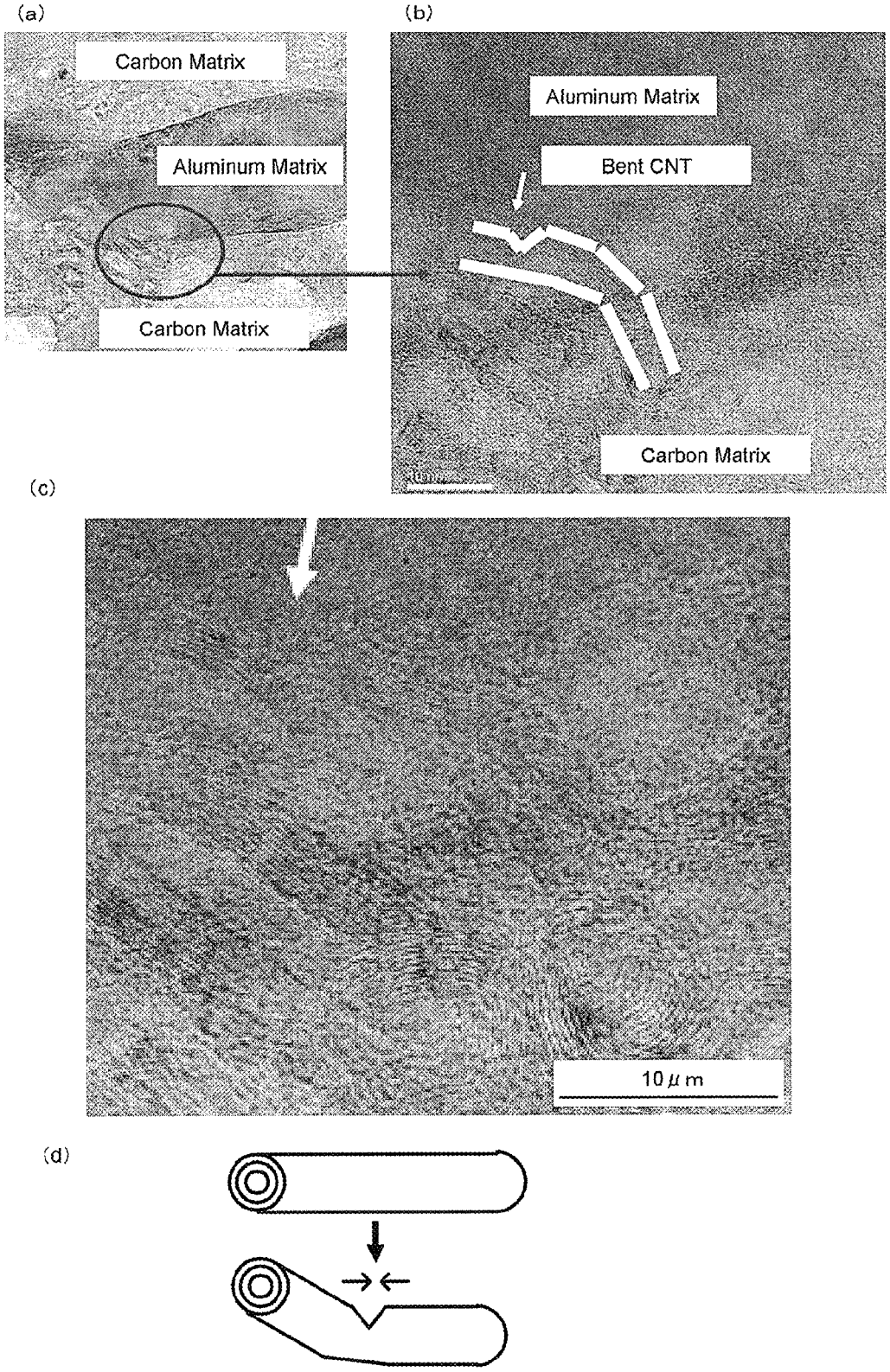
FIG. 16 (*a*) TEM image of a material wire of Example 3, (b) higher-magnification TEM image of (*a*), (*c*) higher-magnification TEM image of (*b*), and (*d*) schematic view showing deformation of carbon nanotube.

FIGS. 15 and 16 show TEM observation results of the material wire of Example 3. The intrinsically circular cross section of a CNT as shown in FIG. 15(*b*) was found to be deformed to a triangular cross section as shown in FIG. 15(*c*). FIG. 16(*b*) is an enlarged image of a part of FIG. 16(*a*), and FIG. 16(*c*) is a further enlarged image. In FIG. 16(*c*), bent carbon nanotubes are observed. FIG. 16(*d*) is a schematic view of a bending mode of a carbon nanotube. In the case where the cross section of a carbon nanotube is deformed to a triangular shape, or a carbon nanotube is bent, when a stress is applied to a carbon nanotube in a shorter direction and a tensile stress is applied to the carbon nanotube in the longitudinal direction thereof, an inner layer present inside the outermost layer in the carbon nanotube is resistive the tensile stress, whereby the tensile strength of the material wire increases.

Example 12

Composite material wires (37 wires) (diameter: 2.6 mm), which had been produced through the same method as employed in Example 11, were twisted together, to thereby produce an electric cable. This cable corresponds to the composite electric cable 61 in the above embodiment.

Example 13

A center galvanized steel wire and composite material wires (36 wires) (diameter: 2.6 mm), which had been produced through the same method as employed in Example 11, were twisted together, to thereby produce an electric cable. This cable corresponds to the composite electric cable 63 in the above embodiment.

Figure 17:
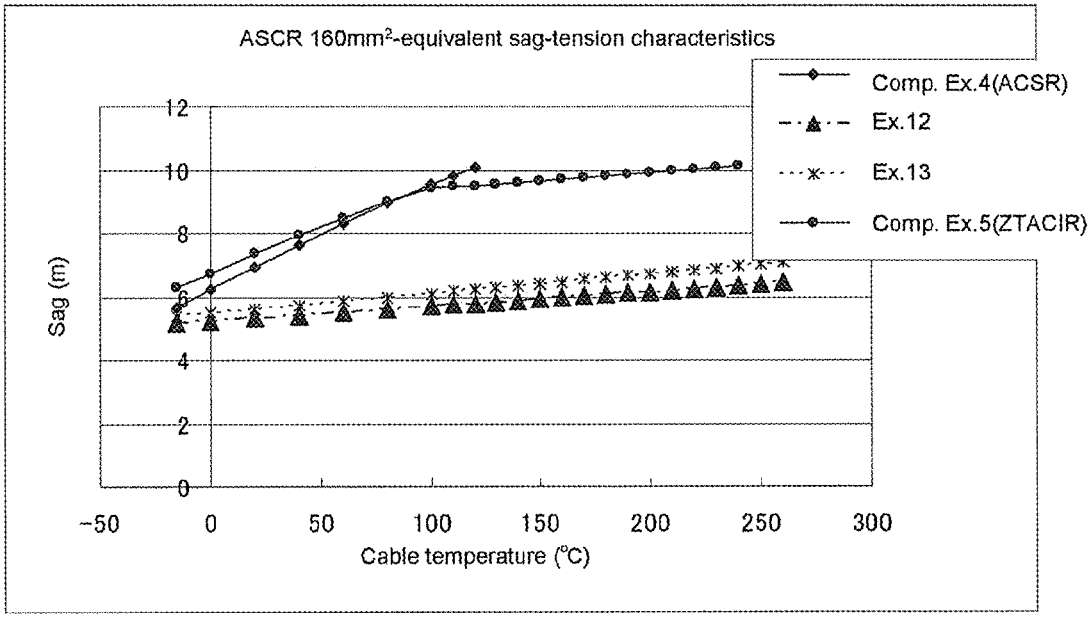
FIG. 17 Graph showing sag-tensile characteristics of electric cables of Examples 12 and 13 and Comparative Examples 4 and 5.

The electric cables of Examples 12 and 13 were measured in terms of minimum tensile load, mass, electrical resistance, elastic coefficient, and linear expansion coefficient. Table 3 shows the results. As cables of Comparative Examples 4 and 5, generally employed ACSR and ZTACIR were measured. Also, sag characteristics of electric cables are shown in FIG. 17.

TABLE 3

| | | | Comp. Ex. 4 | Ex. 12 | Ex. 13 | Comp. Ex. 5 |
|---|---|---|---|---|---|---|
| Size | | $mm^2$ | 160 | 160 | 160 | 160 |
| Twisted wire combination | Al etc. | /mm | HAI 30/2.6 | composite 37/2.6 | composite 36/2.6 | ZTAL 30/2.6 |
| | Steel etc. | /mm | Steel wire 7/2.6 | | Steel wire 1/2.6 | Invar 7/2.6 |

TABLE 3-continued

| | | | Comp. Ex. 4 | Ex. 12 | Ex. 13 | Comp. Ex. 5 |
|---|---|---|---|---|---|---|
| Outer diameter | | mm | 18.2 | 18.2 | 18.2 | 18.2 |
| Min. tensile load | | kN | 68.4 | 89.6 | 93.5 | 60.3 |
| Cross sectional area | Al etc. | $mm^2$ | 159.3 | 196.4 | 191.1 | 159.3 |
| | Steel etc. | $mm^2$ | 37.2 | | 5.3 | 37.2 |
| | Total | $mm^2$ | 196.5 | 196.4 | 196.4 | 196.5 |
| Mass | | kg/km | 733 | 541 | 571 | 740 |
| Resistance | | ohm/km | 0.18 | 0.15 | 0.15 | 0.19 |
| Elastic coefficient | Equivalent | GPa | 89 | 62 | 66 | 81 |
| | Over transition point | GPa | — | — | — | 162 |
| Linear expansion coeff. | Equivalent | $10^{-6}$/K | 18 | 23 | 3.1 | 15 |
| | Over transition point | $10^{-6}$/K | — | — | — | 3.6 |

As is clear from Table 3, the composite electric cable of Example 12 including 37 composite material wires was lighter than conventional ACSR (Comparative Example 4) and exhibited a minimum tensile load equivalent to or higher than that of conventional ACSR. Since the composite electric cable of the invention exhibited a comparable mechanical strength and had a light weight, the cable can be laid with a small sag, whereby current capacity can be increased without piling up transmission line towers. Regarding sag characteristics, the electric cable of the present invention exhibits a linear expansion coefficient 1/10 that of conventional aluminum wire and a small increase in sag during temperature elevation. As compared with ACSR (Comparative Example 4) and Invar electric cable (ZTACIR) (Comparative Example 5), the sag is about 60% at high temperature.

In the case where a fire (e.g., a forest fire) occurs under a transmission cable, the cable is heated at a temperature higher than the melting point, possibly resulting in breakage of an aluminum wire. Through employment of the composite electric cable of Example 13 in which a galvanized steel wire is employed as a center element wire, breakage of the twisted wire at a fire under the cable can be prevented. As shown in Table 3, the mass of the electric cable of the invention is less than that of conventional ACSR (Comparative Example 4) and has a high tensile load. Although the cable of Example 13 exhibits sag characteristics slightly inferior to those of the cable of Example 12, the cable of Example 13 can be laid at a sag as small as about 60% that of ACSR or Invar electric cable (ZTACIR).

DESCRIPTION OF REFERENCE NUMERALS

1 Material wire of a composite material comprising aluminum material and carbon nanotubes dispersed in the aluminum material
3 Inside portion of the wall
5 Wall portion
7 Cellulation structure
8 Crystal grains
13 Billet
15 Container
17 Ram
19 Die
21 Cladding member
23 Lid member
41 Material wire
43 Core portion
45 Clad portion
47 Material wire
49 Core portion
51 Clad portion
53 Material wire
55 Coating part
61 Composite electric cable
63 Composite electric cable
65 Steel wire
67 Composite electric cable
69 Composite electric cable
71 Aluminum alloy wire

FIG. 1

61 Composite electric cable
1 Material wire
65 Steel wire
71 Aluminum alloy wire

FIG. 15

Carbon matrix
Deformed CNT (triangular)

FIG. 16

Carbon matrix
Aluminum matric
Bent CNT

FIG. 17

ACSR 160 $mm^2$-equivalent sag-tension characteristics
Sag (m)
Cable temperature (° C.)
Comp. Ex.
Ex.

The invention claimed is:

1. A composite electric cable comprising:

a plurality of element wires twisted together, wherein the element wires include a carbon-nanotube-containing aluminum element wire which is a material wire formed of a composite material comprising an aluminum material and carbon nanotubes dispersed in the aluminum material;

the carbon-nanotube-containing aluminum element wire has a cellulation structure including a wall portion containing the carbon nanotubes and an inside portion of the wall which is surrounded by the wall portion and which comprises the aluminum material and unavoidable impurities;

the carbon-nanotube-containing aluminum element wire has a ratio of carbon nanotube content to aluminum material content of 0.2 wt. % to 5 wt. %;

the carbon-nanotube-containing aluminum element wire has a tensile strength of 150 MPa or higher and a linear expansion coefficient of $10\times10^{-6}$/K or less as measured at 293 K; and each of all the element wires forming the composite electric cable is the carbon-nanotube-containing aluminum element wire, or the composite electric cable includes in a center portion thereof one or a plurality of steel wires.

2. A composite electric cable according to claim 1, wherein at least a part of the inside portion of the wall of the carbon-nanotube-containing aluminum element wire assumes a polycrystalline structure formed of a plurality of crystal grains.

3. A composite electric cable according to claim 1, wherein the cellulation structure has a diameter of 100 μm or less as viewed in a cross section of the element wire in a direction orthogonal to the longitudinal direction thereof.

4. A composite electric cable according to claim 1, wherein the inside portion of the wall has a size of 5 μm or less as viewed in a cross section of the element wire in a direction orthogonal to the longitudinal direction thereof.

5. A composite electric cable according to claim 1, wherein:

the carbon-nanotube-containing aluminum element wire has a plurality of similar cellulation structures as viewed in a cross section the carbon-nanotube-containing aluminum element wire orthogonal to the longitudinal direction thereof;

the inside portion of the wall of the carbon-nanotube-containing aluminum element wire is long in the longitudinal direction of the carbon-nanotube-containing aluminum element wire and short in a direction orthogonal to the longitudinal direction of the carbon-nanotube-containing aluminum element wire; and at least a part of the wall portion has a generally tubular shape such that the longitudinal direction of the wall portion is approximately parallel to the longitudinal direction of the carbon-nanotube-containing aluminum element wire.

6. A composite electric cable according to claim 1, wherein:

the wall portion of the carbon-nanotube-containing aluminum element wire has a textile-like structure formed of a plurality of carbon nanotubes;

the textile-like structure encloses the aluminum material in the inside portion of the wall enclosed by the wall portion;

the carbon nanotubes forming the wall portion are in contact with the surface of the inside portion of the wall formed of the aluminum material and are themselves in contact with one another; and the carbon-nanotube-containing aluminum element wire has both the cellulation structure in a cross section parallel to the longitudinal direction thereof and in a cross section orthogonal to the longitudinal direction thereof.

7. A composite electric cable according to claim 1, wherein the carbon-nanotube-containing aluminum element wire has a core portion containing carbon nanotubes and having the cellulation structure, and a clad portion having a carbon nanotube concentration lower than that of the core portion or containing no carbon nanotube and having no cellulation structure.

8. A composite electric cable according to claim 1, wherein the carbon-nanotube-containing aluminum element wire has first and second regions alternately and concentrically arranged, wherein the first region comprises an aluminum material and unavoidable impurities and has no cellulation structure, and the second region contains carbon nanotubes and has the cellulation structure.

9. A composite electric cable according to claim 1, wherein the wall portion of the carbon-nanotube-containing aluminum element wire contains carbon nanotubes in an amount greater than the amount of carbon nanotubes in the inside portion of the wall.

10. A composite electric cable according to claim 1, wherein the wall portion of the carbon-nanotube-containing aluminum element wire has an aluminum oxide concentration higher than that of the inside portion of the wall.

11. A composite electric cable according to claim 1, wherein:

a plurality of wall portions of the cellulation structure are in contact with one another as viewed in a cross section of the carbon-nanotube-containing aluminum element wire orthogonal to the longitudinal direction thereof;

the wall portion of the carbon-nanotube-containing aluminum element wire has a circle-like shape including a line as a part thereof, an elliptic shape including a line as a part thereof, or a generally polygonal shape formed by a plurality of lines; and the carbon-nanotube-containing aluminum element wire has a plurality of similar cellulation structures as viewed in a cross section of the carbon-nanotube-containing aluminum element wire orthogonal to the longitudinal direction thereof.

12. A composite electric cable according to claim 1, wherein each carbon nanotube contained in the carbon-nanotube-containing aluminum element wire is bent and/or deformed to a generally triangular shape, as viewed in a cross section of the carbon nanotube in a direction orthogonal to the longitudinal direction thereof, as a result of application of a stress applied to the carbon nanotube in a direction orthogonal to the longitudinal direction thereof.

13. A composite electric cable according to claim 1, wherein the wall portion of the carbon-nanotube-containing aluminum element wire contains carbon nanotubes having a length of 1 μm or shorter, and a plurality of inside portions of the wall are connected to one another by the mediation of carbon nanotubes having a length of 10 μm or longer.

14. A composite electric cable according to claim 1, wherein the carbon-nanotube-containing aluminum element wire contains carbon nanotubes having a length of 1 μm or shorter and carbon nanotubes having a length of 10 μm or longer, and has a peak in the length region of 1 μm or shorter and a peak in the length region of 10 μm or longer, observed in a length distribution profile thereof.

15. A composite electric cable according to claim 1, wherein the inside portion of the wall of the carbon-nanotube-containing aluminum element wire has a length in the longitudinal direction thereof 100 times or less the length of the element wire in a direction orthogonal to the longitudinal direction thereof.

16. A composite electric cable according to claim 1, wherein the carbon-nanotube-containing aluminum element wire is not a center wire.

17. A composite electric cable according to claim 1, wherein the element wires include an aluminum wire and/or an aluminum alloy wire in combination with the carbon-nanotube-containing aluminum element wire.

18. A composite electric cable according to claim 1, wherein the carbon-nanotube-containing aluminum element wire has a tensile strength equal to or higher than that of aluminum and an electrical conductivity 90% or higher that of aluminum.

19. A composite electric cable according to claim 1, wherein the carbon-nanotube-containing aluminum element wire has a linear expansion coefficient equal to or lower than that of aluminum and an electrical conductivity 90% or higher that of aluminum.

20. A composite electric cable according to claim 1, wherein the carbon-nanotube-containing aluminum element wire has a melting temperature equal to or higher than that of aluminum and an electrical conductivity 90% or higher that of aluminum.

21. A composite electric cable according to claim 1, wherein the composite electric cable is coated with a resin.

22. A method for producing the composite electric cable according to claim 1, the method comprising:

a step (a) of mixing an elastomer, aluminum material particles, and carbon nanotubes, to thereby prepare a mixture;

a step (b) of heating the mixture so as to vaporize and decompose the elastomer, to thereby prepare a raw material;

a step (c) of sintering the raw material, to thereby form a billet;

a step (d) of drawing the billet through a die, to thereby form a carbon-nanotube-containing aluminum element wire made of a composite material; and a step (e) of twisting together element wires including the carbon-nanotube-containing aluminum element wire.

23. A method for producing the composite electric cable according to claim 1, the method comprising:

a step (a) of mixing an elastomer, aluminum material particles, and carbon nanotubes, to thereby prepare a mixture;

a step (b) of heating the mixture so as to vaporize and decompose the elastomer, to thereby prepare a raw material;

a step (c) of sintering the raw material, to thereby form a billet;

a step (d) of hot-extruding the billet, to thereby form a carbon-nanotube-containing aluminum element wire made of a composite material as a extruded material; and a step (e) of twisting together element wires including the carbon-nanotube-containing aluminum element wire.

24. A method for producing the composite electric cable according to claim 1, the method comprising:

a step (a) of mixing an elastomer, aluminum material particles, and carbon nanotubes, to thereby prepare a mixture;

a step (b) of heating the mixture so as to vaporize and decompose the elastomer, to thereby prepare a raw material;

a step (c) of sintering the raw material, to thereby form a billet;

a step (d) of hot-extruding the billet, to thereby form an extruded material;

a step (e) of drawing the extruded material through a die, to thereby form a carbon-nanotube-containing aluminum element wire made of a composite material; and a step (f) of twisting together element wires including the carbon-nanotube-containing aluminum element wire.

* * * * *